US011396998B2

(12) United States Patent
Germain et al.

(10) Patent No.: US 11,396,998 B2
(45) Date of Patent: Jul. 26, 2022

(54) MECHANICAL AND ELECTRIC CONNECTION APPARATUS FOR CONTINUOUS RUN LUMINAIRES

(71) Applicant: Current Lighting Solutions, LLC, East Cleveland, OH (US)

(72) Inventors: Steve Germain, Lachine (CA); Yaseen Waheed, Lachine (CA)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 418 days.

(21) Appl. No.: 16/260,224

(22) Filed: Jan. 29, 2019

(65) Prior Publication Data

US 2020/0041103 A1 Feb. 6, 2020

Related U.S. Application Data

(60) Provisional application No. 62/712,973, filed on Aug. 1, 2018.

(51) Int. Cl.

| | |
|---|---|
| ***F21V 19/00*** | (2006.01) |
| ***F21S 4/28*** | (2016.01) |
| ***F21V 21/005*** | (2006.01) |
| ***F21V 21/02*** | (2006.01) |
| *F21Y 103/10* | (2016.01) |
| *F21Y 115/10* | (2016.01) |

(52) U.S. Cl.

CPC ..... *F21V 19/003* (2013.01); *F21S 4/28* (2016.01); *F21V 19/0085* (2013.01); *F21V 21/005* (2013.01); *F21V 21/02* (2013.01); *F21Y 2103/10* (2016.08); *F21Y 2115/10* (2016.08)

(58) Field of Classification Search

CPC .. F21V 19/003; F21V 19/0035; F21V 19/004; F21V 19/0045; F21V 19/005; F21V 19/0085; F21V 21/02; F21S 4/28

See application file for complete search history.

(56) References Cited

U.S. PATENT DOCUMENTS

| | | | | |
|---|---|---|---|---|
| 9,644,828 | B1 * | 5/2017 | May | F21V 23/06 |
| 10,718,499 | B1 * | 7/2020 | DiFelice | F16C 11/0695 |
| 2008/0198590 | A1 * | 8/2008 | Kuo | F21V 23/06 362/219 |
| 2009/0207602 | A1 * | 8/2009 | Reed | F21S 2/005 362/225 |

(Continued)

*Primary Examiner* — Gerald J Sufleta, II

(74) *Attorney, Agent, or Firm* — Buckley, Maschoff & Talwalkar LLC

(57) ABSTRACT

Methods, apparatus and systems for facilitating installation and/or replacement of linear lighting assemblies with linear light-emitting diode (LED) luminaires. In an embodiment, a system for installing a linear LED luminaire includes a suspension bracket having a connection feature for connection to a connection point, and an attachment portion for accepting a first distal end of a first linear LED luminaire. The system also includes a connecting bridge that includes a bridge housing, at least one aperture formed in the bridge housing, and at least one locking tab. The connecting bridge attaches to a second distal end of the first linear LED luminaire and enables secure mechanical and electrical connection between the first linear LED luminaire and a second LED luminaire.

13 Claims, 20 Drawing Sheets

(56) References Cited

U.S. PATENT DOCUMENTS

| | | | | |
|---|---|---|---|---|
| 2012/0075871 | A1* | 3/2012 | Chen | F21S 2/005 362/362 |
| 2012/0092875 | A1* | 4/2012 | Cho | F21S 2/005 362/311.01 |
| 2013/0141923 | A1* | 6/2013 | Ekey | F21V 15/015 362/432 |
| 2015/0338068 | A1* | 11/2015 | Bolscher | F21V 23/06 362/219 |
| 2016/0201890 | A1* | 7/2016 | Sorensen | H01R 13/625 362/219 |
| 2016/0356433 | A1* | 12/2016 | Xu | F21V 21/00 |
| 2017/0314765 | A1* | 11/2017 | Yu | G02B 5/045 |
| 2018/0299082 | A1* | 10/2018 | Li | F21V 19/004 |
| 2021/0116080 | A1* | 4/2021 | Tan | F21V 21/005 |

* cited by examiner

MECHANICAL AND ELECTRIC CONNECTION APPARATUS FOR CONTINUOUS RUN LUMINAIRES

FIELD OF THE INVENTION

The present disclosure generally relates to apparatus and methods for facilitating installation and/or replacement of linear lighting assemblies, such as fluorescent light tubes, with linear light-emitting diode (LED) luminaires. In some embodiments, a starter bridge component and one or more connecting bridges are utilized to provide both electrical and mechanical connections to be made between linear LED luminaires in one step, which both facilitates the ease of installation and improves the speed of installation.

BACKGROUND

Conventional linear light fixtures typically house linear fluorescent (FL) tube lamps and are affixed to the ceiling, for example, in rooms or hallways in commercial buildings and/or private residences. When affixed to the ceiling, linear light fixtures and their linear FL tube lamps are designed to emit light in a downward direction, and the FL tube lamps can be removed from the light fixture when replacement is needed. In addition, the ballast circuitry and/or power supply circuitry and/or wiring may be removed and/or adjusted in the linear light fixture. The term "light fixture" as used herein generally refers to the portion of a lighting apparatus that is attached to a ceiling and that removably houses a light engine or luminaire or other lighting element, and that remains attached to the ceiling after removal of the lighting element. Linear light fixtures are typically made of sheet metal and are not easily removed. In some installations, various components of a linear light fixture may be used to mechanically hold a new or replacement luminaire on the ceiling.

Light-emitting diode (LED) tubes or LED luminaires are now being used to replace linear FL lamps in existing linear light fixtures because LED luminaires are now widely accepted as a more efficient and environmentally friendly light source than FL lamps. For example, benefits of using linear LED luminaires include being able to operate in extreme conditions, longer life, and better energy efficiency. Thus, LED luminaires have been designed to replace, and/or be retrofit for, linear FL tube lamps. Accordingly, linear LED luminaires are available that are about four-feet in length (about 1.21 m) to approximate or equal the length of many existing linear FL tube lamps, which are currently used in many settings.

Each LED luminaire typically includes an elongated, hollow heat sink which usually is metallic, and may be formed as a single extruded metallic piece. When initially fabricated, the elongated hollow heat sink typically has open ends at each longitudinal distal end. The presence of such open ends may facilitate the insertion and placement of one or more power supply units (PSUs) along with placement of wiring into the hollow interior of the heat sink. Each LED luminaire in an assembly of a plurality of LED luminaires may have two identical end caps covering the openings of the hollow elongated heat sink, and in some embodiments the end caps are identical.

A circuit board assembly (CBA) may be mounted on one or more exterior surfaces of the elongated hollow heat sink, and the CBA may include one or more LED light sources. The LED light sources in such linear LED luminaires allow electrical current to pass through the device in only one direction while blocking current flow in the opposite direction. At least one power supply unit (PSU) may be installed inside the hollow elongated heat sink to power the LED light sources of a given luminaire, and may include an LED driver circuit for driving the LED light sources. In some embodiments, a plurality of LED light sources are mounted in a generally linear fashion on the CBA and emit light when operational, in a direction away from the elongated hollow heat sink. To shape and/or modify the emitted light, an elongated optical cover may be placed over the plurality of LED light sources that may diffuse the emitted light and/or otherwise direct and/or refract and/or reflect the emitted light. In some embodiments, this elongated optical cover is referred to as a "lens," and is approximately the same length as the elongated hollow heat sink.

When installing linear LED luminaires into existing linear light fixtures (which housed FL tube lamps), it is sometimes advantageous to align the linear LED luminaires with one or more components found on the existing linear light fixtures. For example, "tombstones" are typically found on existing linear lamp fixtures (which are shaped like a tombstone, and thus hence the name) and are sockets used for attaching the fluorescent tube lamps to a light fixture. In a typical configuration, two tombstones are available for accepting a FL tube, and are located or spaced apart to accept the opposite ends of the FL tube. The tombstones provide mechanical support as well as the electrical connection for each FL tube to a ceiling or wall, for example. However, an alignment component is not always necessary because other methods for aligning LED luminaires could be used. It should also be noted that typically, retrofitting or replacing a sixteen-foot length of FL tube lamps (consisting of four, 4-foot long FL lamps) with linear LED luminaires may take anywhere from about eight to ten minutes, which can increase the labor costs for any large LED luminaire replacement job (for example, replacing linear FL lamps with linear LED luminaires that are illuminating a factory floor or large office space).

Thus, it would be advantageous to provide apparatus and methods for facilitating installation of linear LED lighting assemblies (linear LED luminaires) into existing linear light fixtures to improve the ease of installation and the speed of installation resulting in lowering installation costs.

BRIEF SUMMARY OF THE INVENTION

Disclosed are apparatus and methods for facilitating installation of linear LED luminaires. In an embodiment, a system for installing a linear LED luminaire includes a suspension bracket and a connection bridge. The suspension bracket includes at least one connection feature for attachment to a connection point, and an attachment portion for accepting a first distal end of a first linear LED luminaire. The connecting bridge includes a bridge housing, at least one aperture formed in the bridge housing, and at least one locking tab. In some implementations, the connecting bridge attaches to a second distal end of the first linear LED luminaire and enables secure mechanical and electrical connection between the first linear LED luminaire and a second LED luminaire when the first linear LED luminaire is aligned with the second LED luminaire and the at least one locking tab is fully inserted into the at least one aperture.

In some implementations, the system may also include a starter bridge having a starter bridge housing and a wiring bridge, the starter bridge housing for attachment to a distal end of a starter linear LED luminaire of a continuous row of linear LED luminaires. The wiring bridge enables passage of electrical wires through the starter linear LED luminaire and enables connection to at least one additional LED luminaire via the connecting bridge. In addition, the system may include a finisher bridge comprising a finisher bridge housing including at least one aperture and a locking tab. The finisher bridge may be attached to a distal end of a linear LED luminaire that is the final linear LED luminaire of a continuous run of linear LED luminaires. In some embodiments, the starter bridge housing may also include wire crimps configured for holding the electrical wires, and the starter bridge may include at least one aperture in the starter bridge housing and a locking tab for insertion into the aperture enabling both a mechanical and an electrical connection of the starter bridge to the starter linear LED luminaire. In some implementations, the starter bridge housing is composed of one of a metal material, a plastic material and a hard polymeric material.

In some embodiments of the system, the at least one connection feature of the suspension bracket connects to one of an alignment point of a linear light fixture, a connection point of a ceiling, a wall or a floor, or a suspension point of a cable, rod or pipe. In addition, the suspension bracket may include at least one screw forming an axis of rotation for the first linear LED luminaire enabling rotation of the first linear LED luminaire and the connecting bridge towards the second luminaire during installation of the first linear LED luminaire. In implementations, the shape of an outer portion of the bridge housing of the connecting bridge may be similar to that of an optical cover of a linear LED luminaire. Also, the connecting bridge may include at least two apertures for receiving a first locking tab associated with a first linear LED luminaire and a second locking tab associated with an adjacent second linear LED luminaire. The connecting bridge may be composed of one of a metal material, a plastic material and a hard polymeric material.

A method for installing a linear LED luminaire is also disclosed. In some implementations, a suspension bracket is affixed to a connection point, then a first end of a connecting bridge is affixed to a first distal end of a first linear LED luminaire, wherein the connecting bridge includes a bridge housing, at least one aperture formed in the bridge housing, and at least one locking tab. The process also includes connecting a second distal end of the first linear LED luminaire to the suspension bracket, and then connecting a second end of the connecting bridge to a second distal end of a second linear LED luminaire enabling secure mechanical and electrical connection between the first linear LED luminaire and the second LED luminaire.

In some embodiments, the connection point may include one of an alignment point of a linear light fixture, a connection point of a ceiling, a wall or a floor, or a suspension point of a cable, rod or pipe. In addition, the process may include affixing a finisher bridge to the second distal end of the first linear LED luminaire, wherein affixing the suspension bracket to the connection point may include utilizing at least one self-tapping screw. In addition, connecting the second end of the connecting bridge to the second distal end of the second linear LED luminaire may include rotating the first linear LED luminaire about a pivot point located on the suspension bracket until the connecting bridge aligns with the second linear LED luminaire.

Another disclosed embodiment relates to a method for installing a linear LED luminaire, including affixing a starter bridge to a distal end of a linear light fixture. The starter bridge may include a starter bridge housing and a wiring bridge enabling passage of electrical wires to power a continuous row of linear LED luminaires. The method also includes affixing a suspension bracket to a connection point, connecting a first distal end of a starter linear LED luminaire to the suspension bracket, and then affixing a second distal end of the starter linear LED luminaire to the starter bridge.

In addition, the method may include affixing a second suspension bracket to a second connection point, affixing a first end of a connecting bridge to a first distal end of a first linear LED luminaire, connecting a second distal end of the first linear LED luminaire to the second suspension bracket, and connecting a second end of the connecting bridge to the first distal end of the starter linear LED luminaire. In some implementations, the connecting bridge includes a bridge housing, at least one aperture formed in the bridge housing, and at least one locking tab, and when the at least one locking tab is inserted then a secure mechanical and electrical connection is made between the first linear LED luminaire and the starter linear LED luminaire. The method may also include affixing a finisher bridge to the second distal end of the first linear LED luminaire. In addition, the first and second connection points comprise one of first and second alignment points of a linear light fixture, first and second connection points located on one of a ceiling, a wall or a floor, or first and second suspension points of cables, rods or pipes.

BRIEF DESCRIPTION OF THE DRAWINGS

Features and advantages of some embodiments, and the manner in which the same are accomplished, will become more readily apparent with reference to the following detailed description taken in conjunction with the accompanying drawings, which illustrate exemplary embodiments (not necessarily drawn to scale), wherein.

DETAILED DESCRIPTION

Figure 1A:
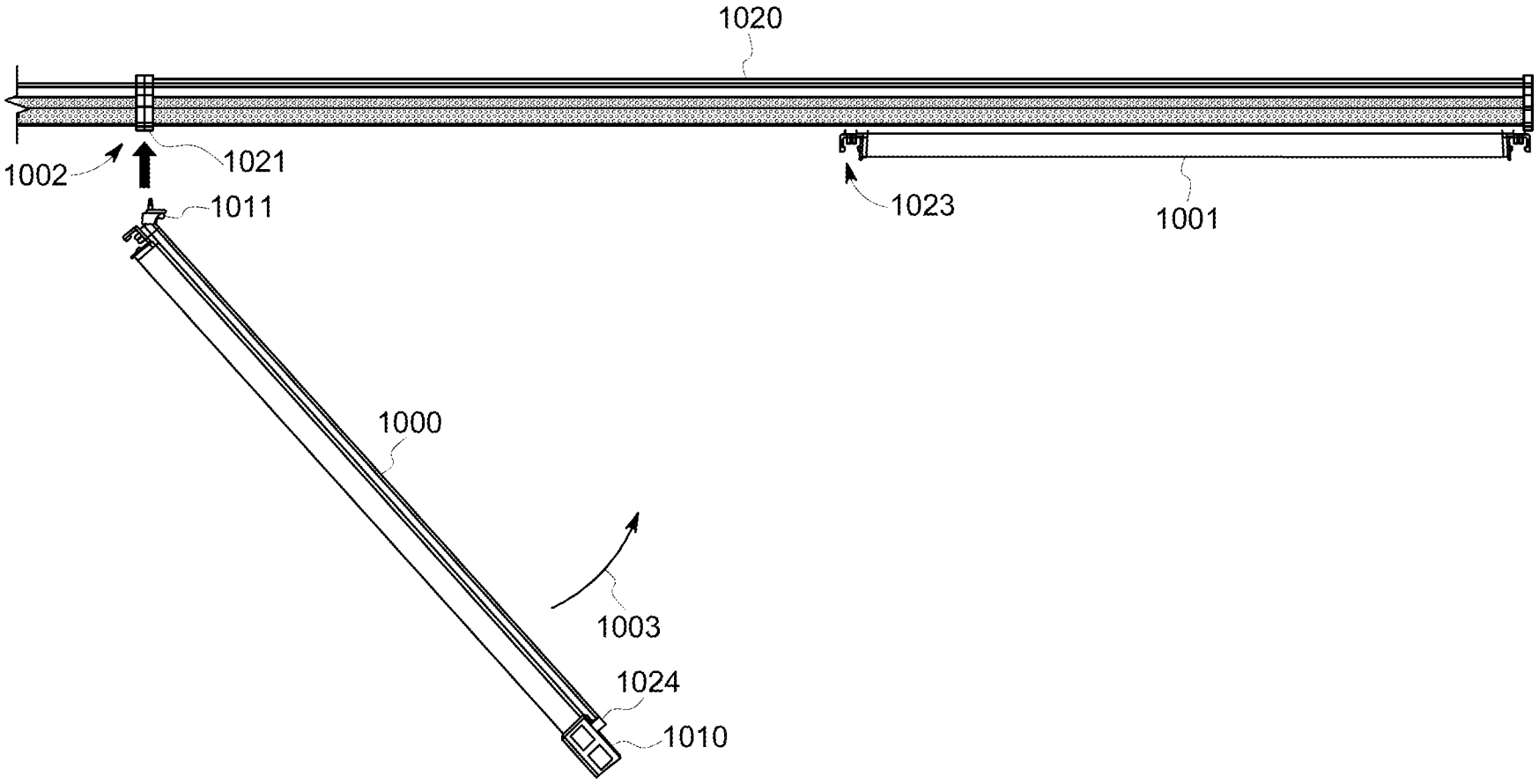
FIGS. 1A to 1G illustrate an example of process for installing a second LED luminaire to a linear lighting fixture after a first LED luminaire has already been installed in accordance with novel aspects of the disclosure.
Figure 1B:
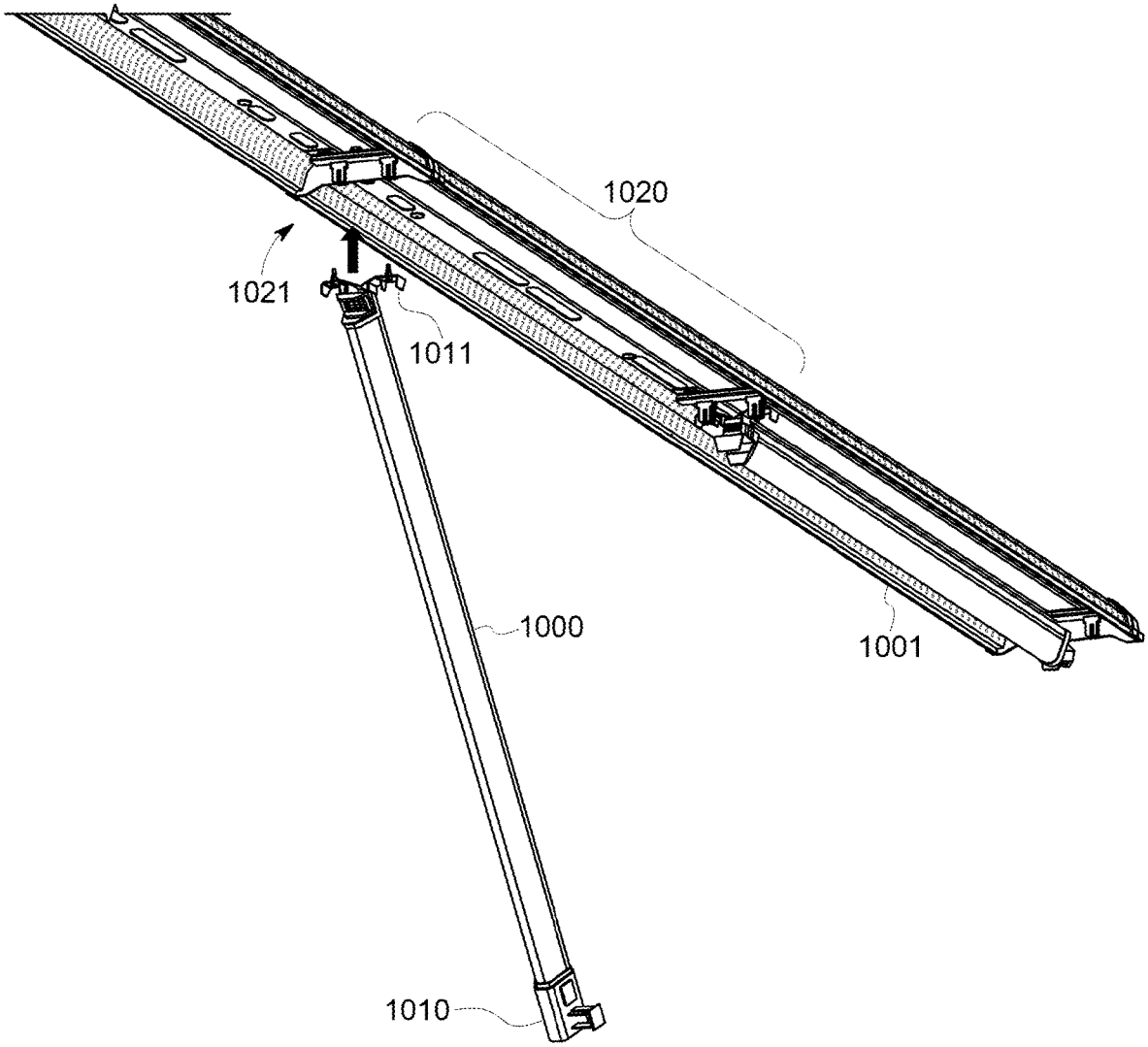
Figure 1C:
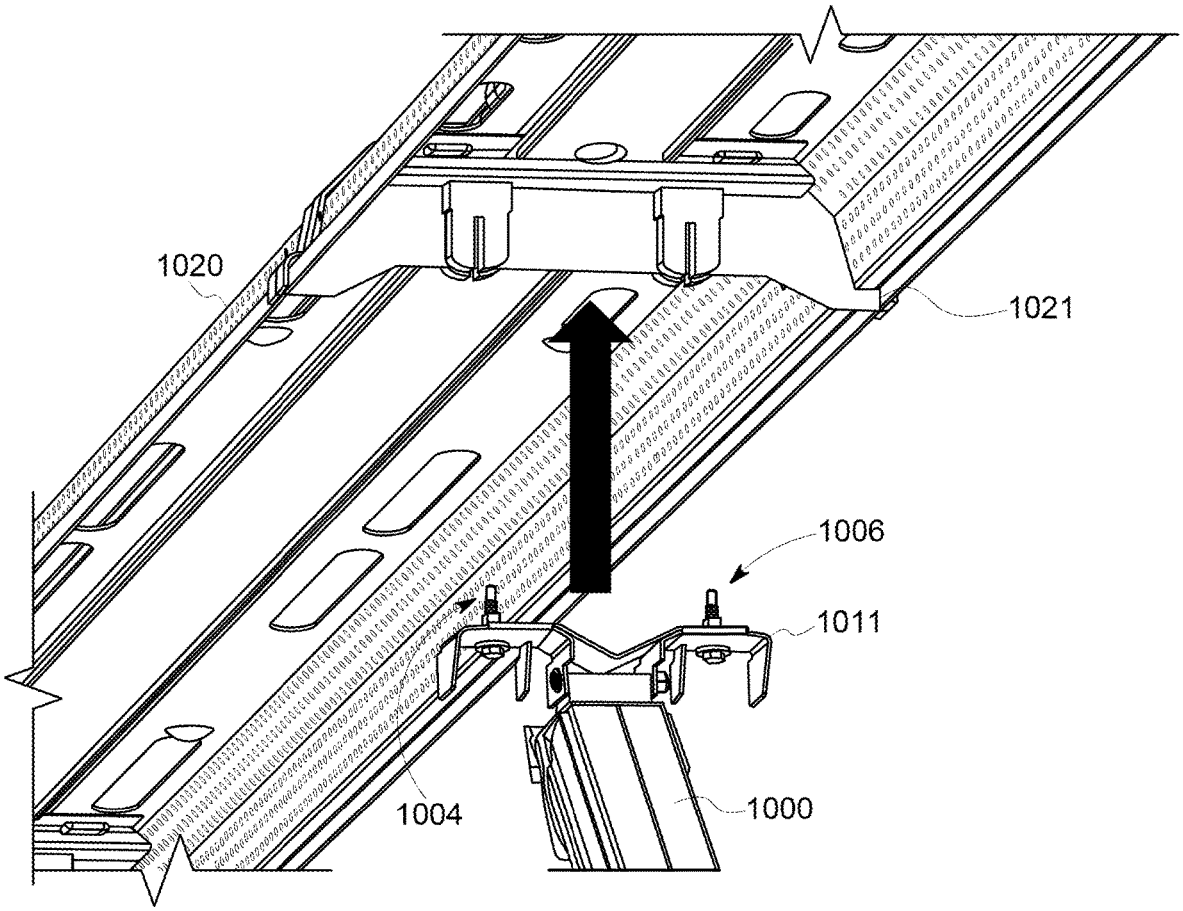

Reference now will be made in detail to illustrative embodiments, one or more examples of which are illustrated in the drawings. Like components and/or items in the various drawings are identified by the same reference number, and each example is provided by way of explanation only and thus does not limit the invention. In fact, it will be apparent to those skilled in the art that various modifications and/or variations can be made without departing from the scope and/or spirit of the invention. For instance, in many cases features illustrated or described as part of one embodiment can be used with another embodiment to yield a further embodiment. Thus, it is intended that the present disclosure covers such modifications and variations as come within the scope of the appended claims and their equivalents.

In general, and for the purpose of introducing concepts of embodiments of the present invention, apparatus and methods are described for facilitating the process of installing and/or replacing linear fluorescent (FL) tube lamps with linear LED lighting assemblies (linear LED luminaires) in a manner which improves the ease of installation and the speed of installation, resulting in lower installation costs. In some embodiments, a linear LED luminaire is provided with a pivoting suspension bracket at one distal end and with a connecting bridge at the other end. The "connecting bridge" is a component that facilitates both a mechanical connection and an electrical connection between adjacent linear LED lighting assemblies that are installed in the same linear light fixture. In addition, embodiments described herein include a starter bridge component. The "starter bridge" component is configured for placement onto a distal end of the first linear LED luminaire in a continuous run of linear LED luminaires, and it facilitates the passage of the wiring needed to provide electrical current from the existing linear light fixture into the continuous run of LED luminaires.

FIGS. 1A to 1G illustrate an example of process for installing a second LED luminaire 1000 to a linear lighting fixture 1020 after a first LED luminaire 1001 has already been installed in accordance with novel aspects of this disclosure. In some cases, the second LED luminaire 1000 is being installed into an already existing linear light fixture 1020 (for example, as a replacement for a linear fluorescent lamp) that is affixed to a ceiling. However, in other cases the installer is installing the second LED luminaire into a new linear light fixture (which may or may not yet be affixed to a ceiling or wall) that may include alignment location features for facilitating installation of linear LED luminaires. In addition, in accordance with some embodiments of the mechanical and electrical apparatus described herein, one or more linear LED luminaires may be directly installed via brackets to, for example, connection points located on a ceiling or wall by itself (in the absence of a linear lighting fixture or any other type of lamp fixture). Moreover, in some implementations one or more linear LED luminaires may be directly installed via brackets to, for example, suspension points of cables, rods or pipes which are connected to and extending from, for example, a wall or ceiling.

Referring to FIG. 1A, a connecting bridge 1010 has already been connected to a first distal end of the second LED luminaire 1000, and a rotative suspension bracket 1011 has been installed at a second distal end of the second linear LED luminaire 1000. As illustrated in FIG. 1A, the rotative suspension bracket 1011 is poised for attachment by an installer to a connection point 1002 of the linear lighting fixture 1020, which may also be considered as an alignment point 1021 location. The connecting bridge 1010 is designed to provide a mechanical and electrical connection between the first distal end 1024 of the second LED luminaire 1000 and the second distal end 1023 of the first linear LED luminaire 1001. In some embodiments, with reference to FIGS. 1B and 1C, the rotative suspension bracket 1011 is screwed into or otherwise attached to the linear lighting fixture 1020 by an installer at the alignment point 1021 location. Typically, the installer uses a first screw 1004 and a second screw 1006 to affix the rotative suspension bracket 1011 to the linear lighting fixture 1020, but more or less screws can be used, and it should be understood that other conventional attachment means or devices (such as clips) could also be used. In some implementations, the first luminaire 1001 includes a rotative suspension bracket of its own located at the second distal end 1023 (on the left side of the first luminaire 1001). However, in some implementations involving two linear LED luminaires 1000 and 1001 there may be three rotative suspension brackets (left, right, and middle) which each may include a pivoting feature.

Figure 1D:
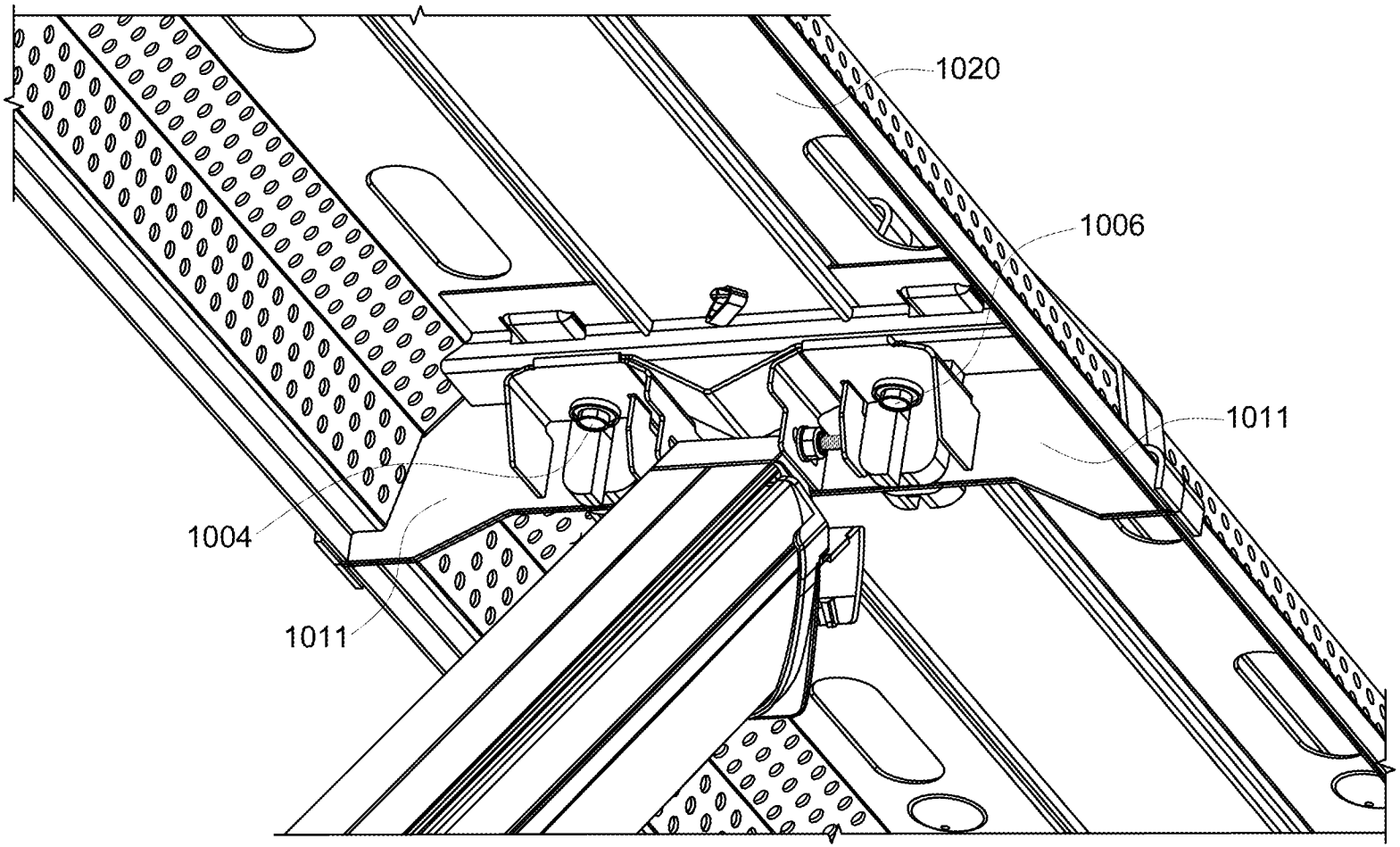

FIG. 1D depicts the rotative suspension bracket 1011 and the second luminaire 1000 fully affixed to the existing linear light fixture 1020, which occurs when the installer drives in the first screw 1004 and the second screw 1006 into the linear light fixture 1020, as shown.

Figure 1E:
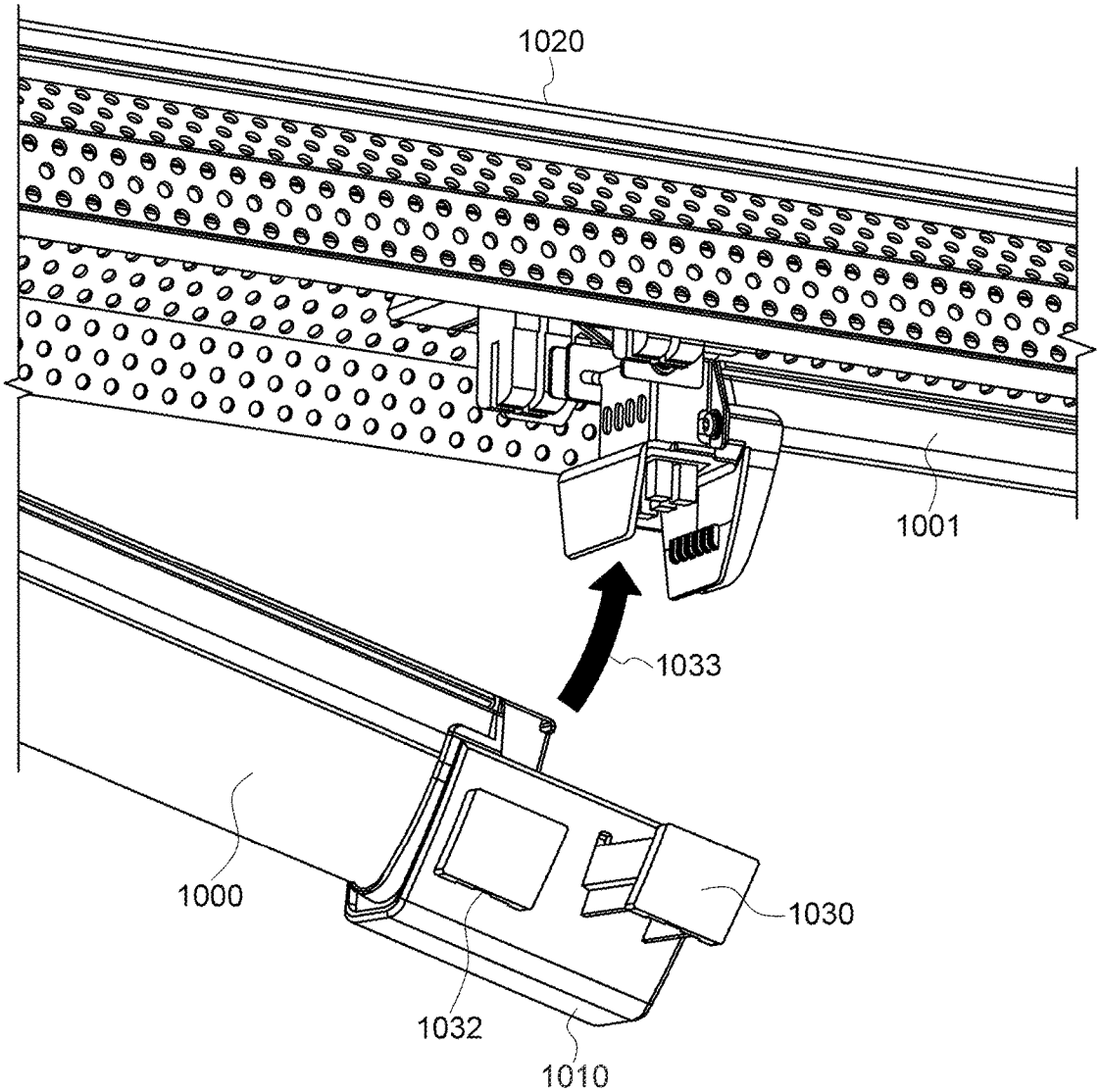

After the rotative suspension bracket 1011 is affixed to the linear light fixture 1020, the installer rotates the second linear LED luminaire 1000 in an upward direction, as shown by the arrow 1033 in FIG. 1E, to be adjacent to the first linear LED luminaire 1001. In this example, a first distal end of the second LED luminaire 1000 has been fitted with the connecting bridge 1010, which covers or encloses an endcap (not shown in FIG. 1E) of the LED luminaire 1000. Thus, in some implementations, the housing of the connecting bridge 1010 is shaped for enclosing the endcaps of adjacent linear LED luminaires. Also, in some embodiments the connecting bridge 1010 includes a first locking tab 1030 and a second locking tab 1032. As shown in FIG. 1E. the second locking tab 1032 is completely inserted which secures the connecting bridge 1010 to the distal end portion of the second luminaire 1000, and the first locking tab 1030 is still extended, and thus not yet inserted. In accordance with implementations disclosed herein, the first locking tab 1030 will not be inserted until the second linear LED luminaire 1000 is rotated fully upwards in the direction of arrow 1033 so that the second linear LED luminaire 1000 is linearly aligned with the first linear LED luminaire 1001.

Figure 1F:
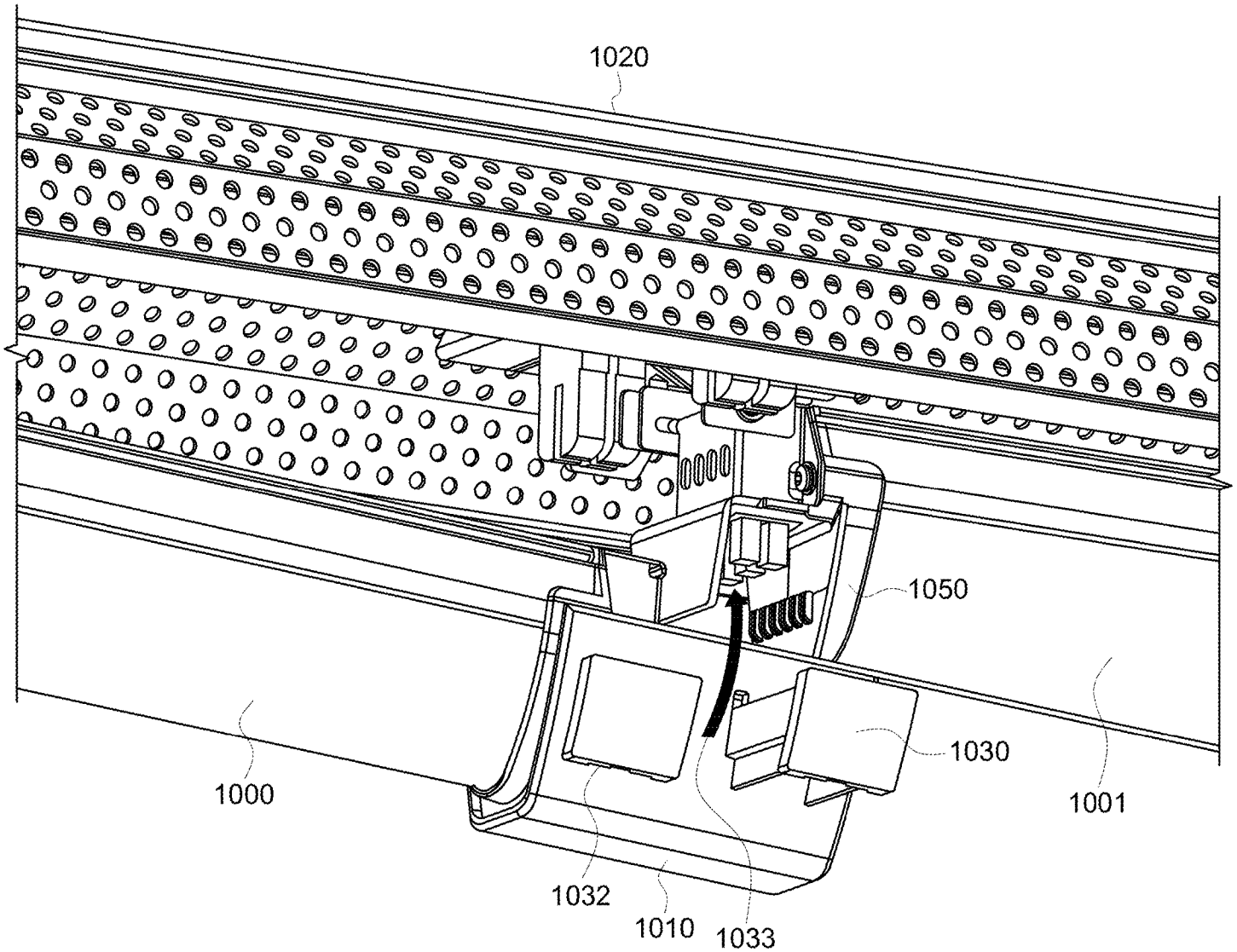
Figure 1G:
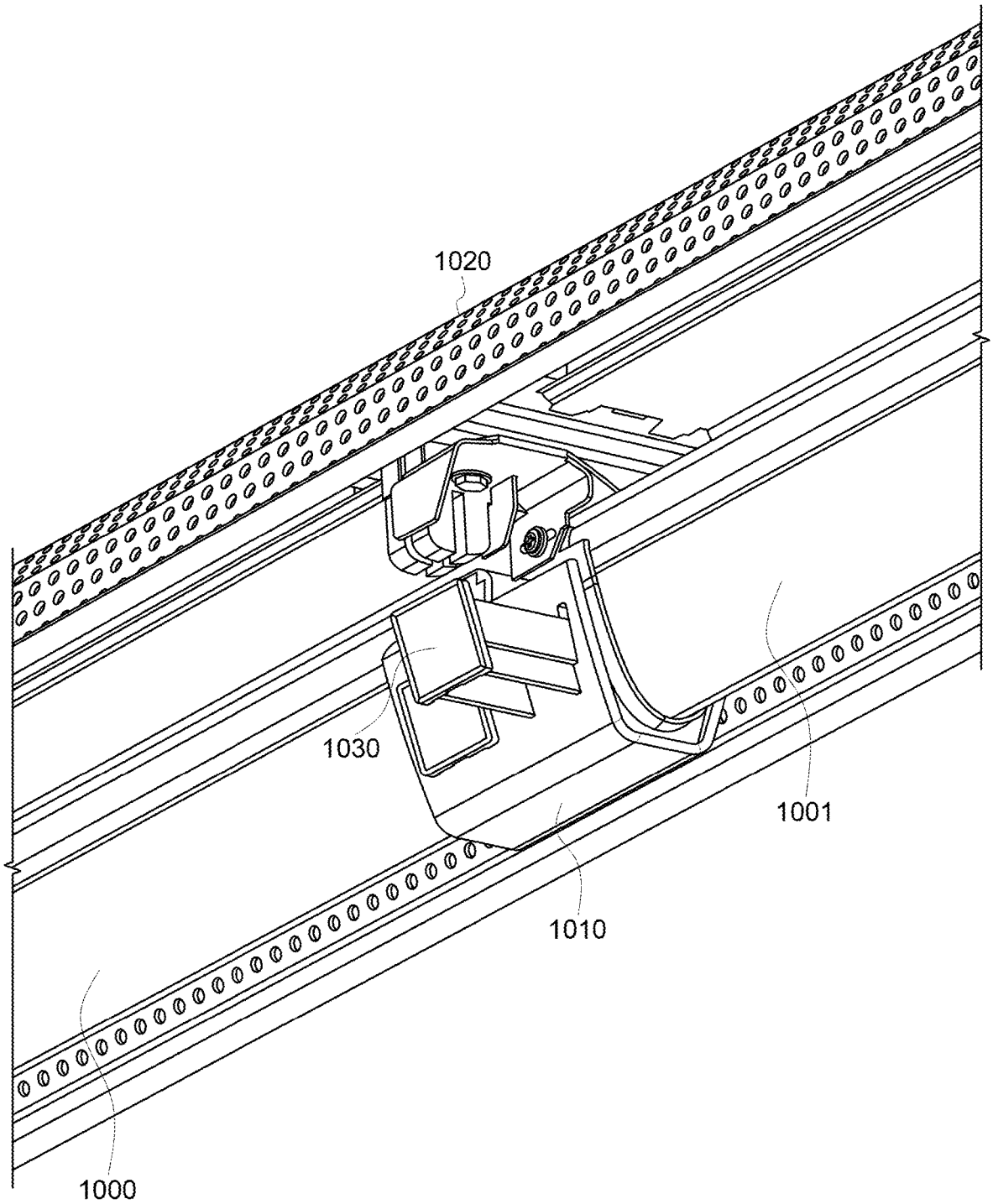

FIGS. 1F and 1G illustrate continuation of the alignment process shown in FIG. 1E. In FIG. 1F, upward rotation of the second LED luminaire 1000 in the direction of arrow 1033 is almost complete. As shown in FIG. 1F, the connecting bridge 1010 is nearly in position to be inserted over an end cap 1050 of the first linear LED luminaire 1001. Once the second linear LED luminaire 1000 is fully linearly aligned with the second linear LED luminaire 1001 (as shown in FIG. 1G), then the locking tab 1030 (protruding outwardly in FIGS. 1F and 1G) is pushed inwardly or inserted by an installer to lock the second linear LED luminaire 1000 in place in linear alignment with the first linear LED luminaire 1001.

As mentioned above, in some embodiments the connecting bridge 1010 is configured for positioning over the endcaps found at the ends of each of the adjacent linear LED luminaires in a continuous line of such light engines (shown as linear LED luminaires 1000 and 1001 in FIGS. 1A-1G). In some implementations, the endcaps of the linear LED luminaires include one or more protrusions (not shown) designed for making electrical and/or mechanical connections (not shown in FIGS. 1A-1G), for example, a protrusion may include crimp contacts for joining wires together. In such embodiments, the connecting bridge 1010 may include an internal wiring bridge having complementary female electrical and mechanical connection locations to accommodate the protrusion(s). Thus, when the connecting bridge 1010 is fully in place as shown in FIG. 1G, and the locking tab is fully inserted or pushed in or snapped in place (to lock the second LED fixture mechanically in place), in addition to the mechanical connection, secure electrical connections are made between the adjacent linear LED luminaires 1000 and 1001. In some embodiments, the act of rotating the connecting bridge 1010 up onto the endcap of the first LED luminaire 1001 creates the electrical connection, and the insertion of the locking tab 1030 secures both the electrical contacts and the mechanical contacts. In some configurations, a generally downward-facing protrusion found on each endcap facilitates the locking into place of the connecting bridge 1010 after the locking tab 1030 (or a locking pin) is fully inserted.

Figure 2A:
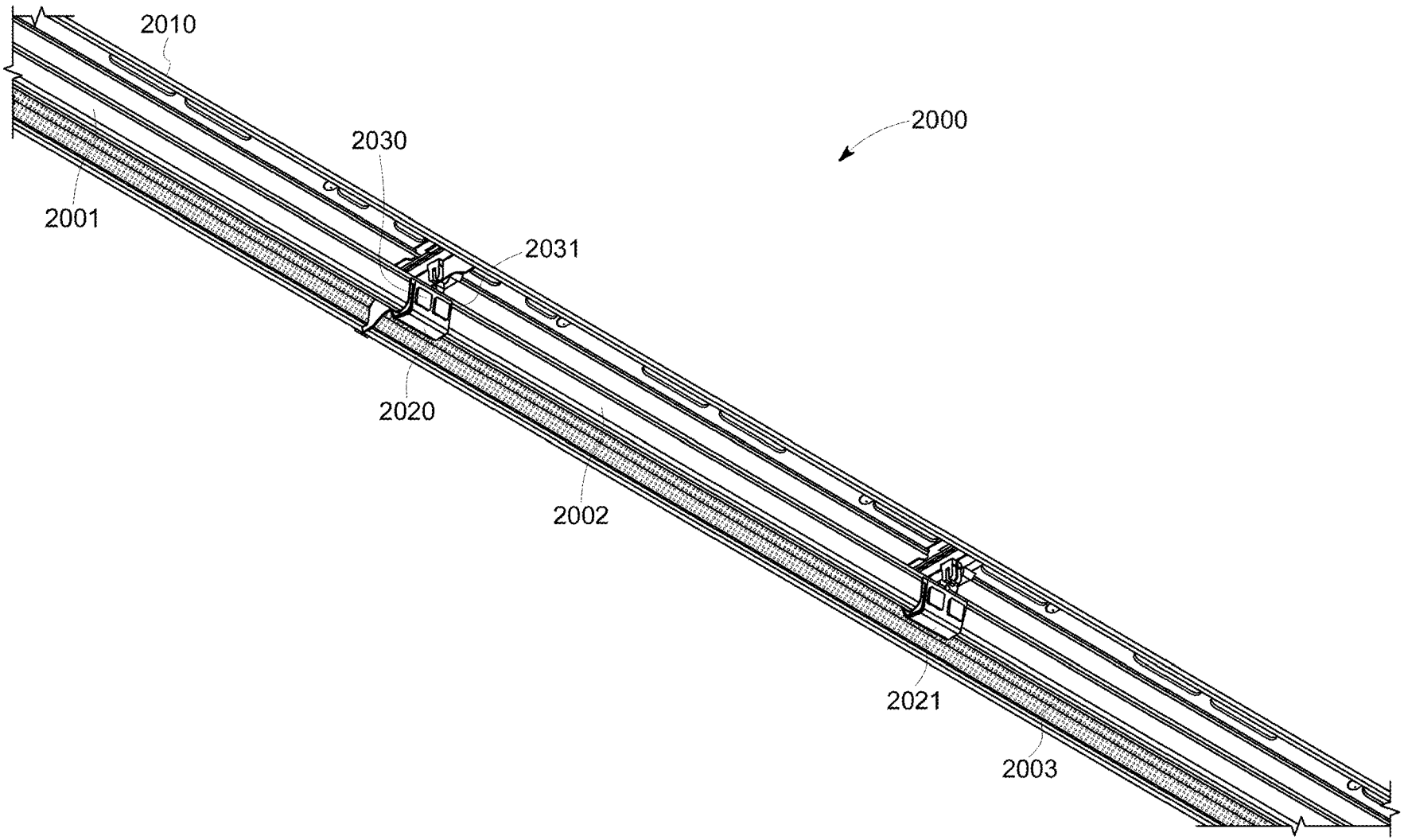
FIGS. 2A to 2G illustrate removal of a linear LED luminaire from a light fixture by an installer from an already-installed arrangement of continuous-run LED luminaires in accordance with some embodiments of the disclosure.
Figure 2B:
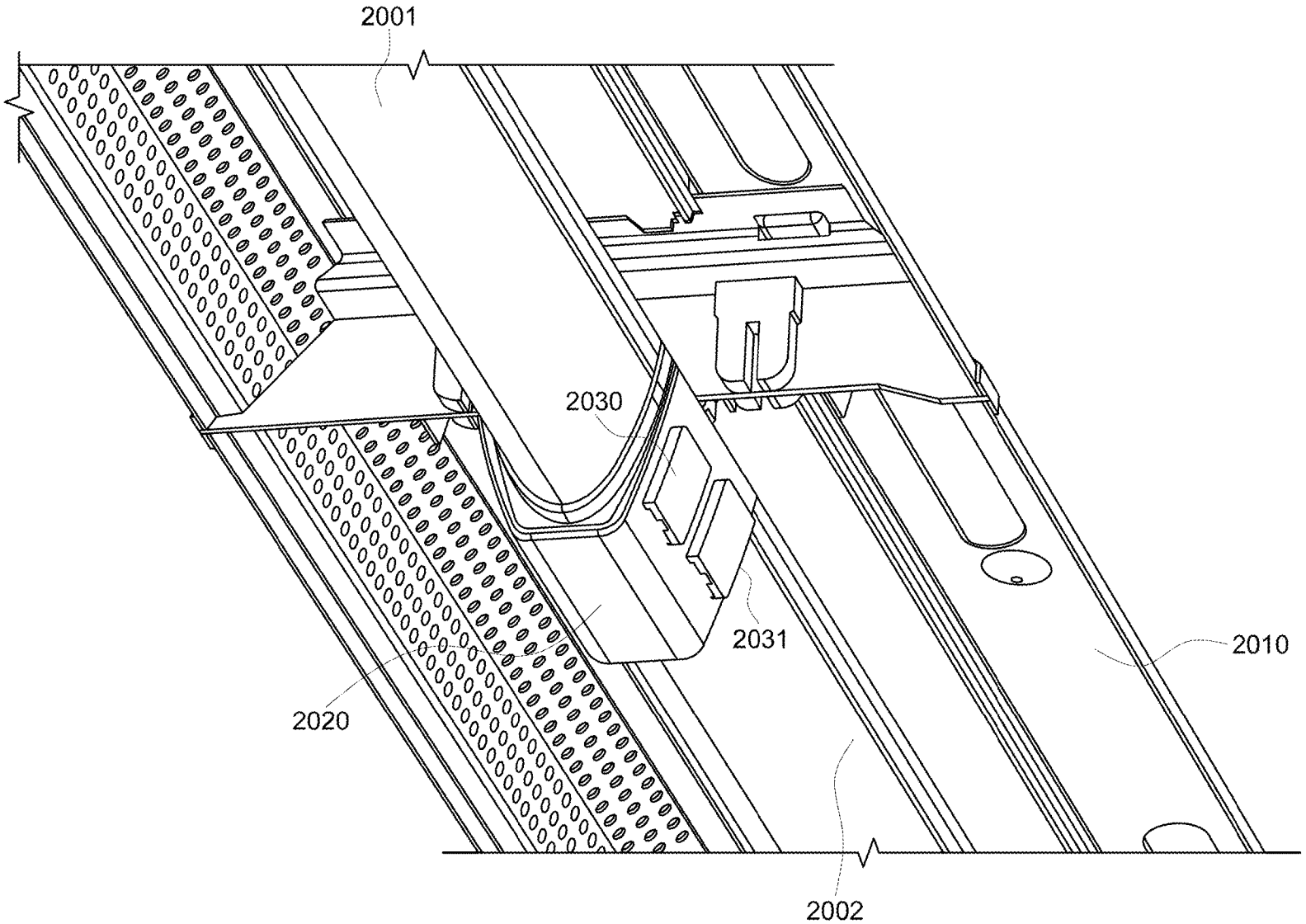
Figure 2C:
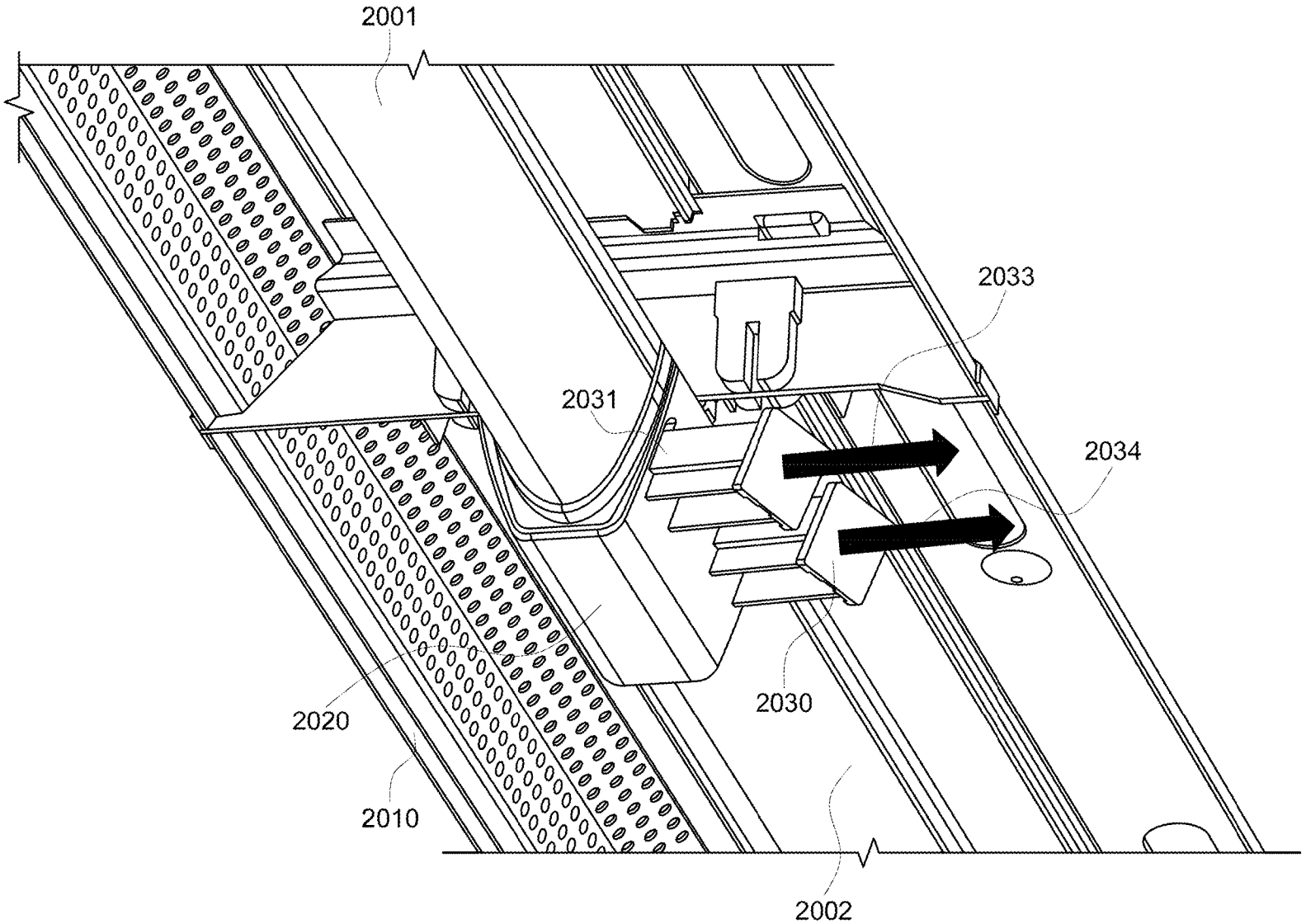
Figure 2D:
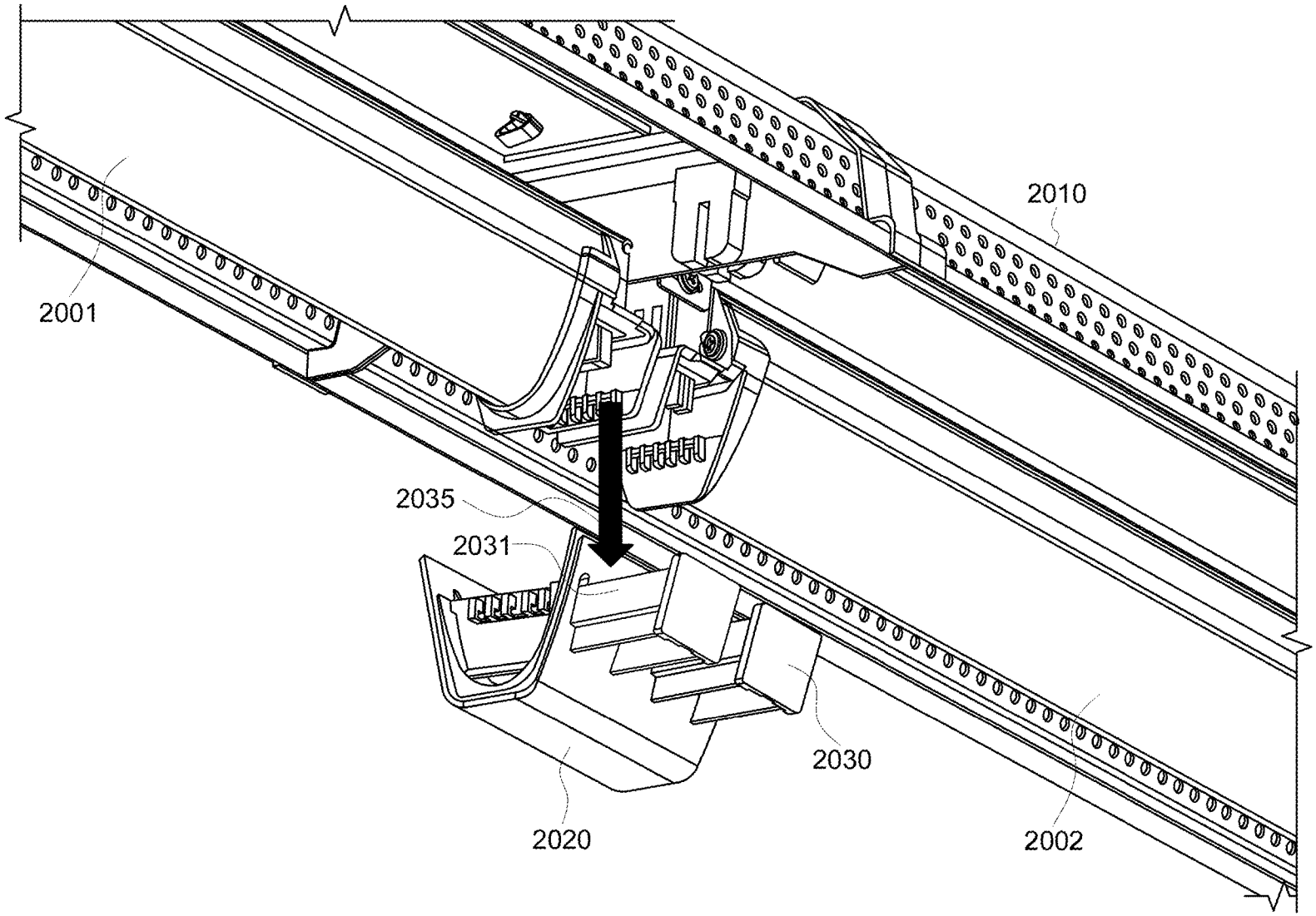

FIGS. 2A to 2G illustrate a process for removing a linear LED luminaire 2002 from an existing light fixture 2010 by an installer from an already-installed arrangement 2000 of continuous-run linear LED luminaires 2001, 2002 and 2003 in accordance with the disclosure. The first step is for the installer to identify which of the linear LED luminaires to remove, which may depend on whether a particular linear LED luminaire is defective or otherwise needs replacement. In this example, the linear LED luminaires 2001, 2002 and 2003 are connected together by a first connecting bridge 2020 and a second connecting bridge 2021. The second linear LED luminaire 2002 is identified as needing to be replaced (and thus removed) from between a first linear LED luminaire 2003 and a third linear LED luminaire 2001. Thus, as shown in FIG. 2A the first connecting bridge 2020 and the second connecting bridge 2021 at each end of the second LED luminaire 2002 must be involved. As shown in FIGS. 2B and 2C, the first connecting bridge 2020 at a leftmost end of the second linear LED luminaire 2002 is to be removed first by pulling locking tabs 2030 and 2031 outwardly in the direction of arrows 2033 and 2034. Next, after both locking tabs 2030 and 2031 are fully extended as shown in FIG. 2D, the first connecting bridge 2020 is removed by pulling it in a downward direction away from the linear light fixture 2020, as indicated by arrow 2035.

It should be understood that at this point in the process, the rightmost distal end of third linear LED luminaire 2001 will have no mechanical support or connection to the linear light fixture 2020, and thus the third linear LED luminaire 2001 must be supported by the installer in some fashion, at least temporarily, during the replacement procedure. Mechanical support for the third linear LED luminaire 2001 may be provided by an installer using his or her hand, or by use of a cable or support rope, or by using some other mechanical expedient (a typical linear LED luminaire may have a weight of about 2.3 kilograms or about 5 pounds).

Figure 2E:
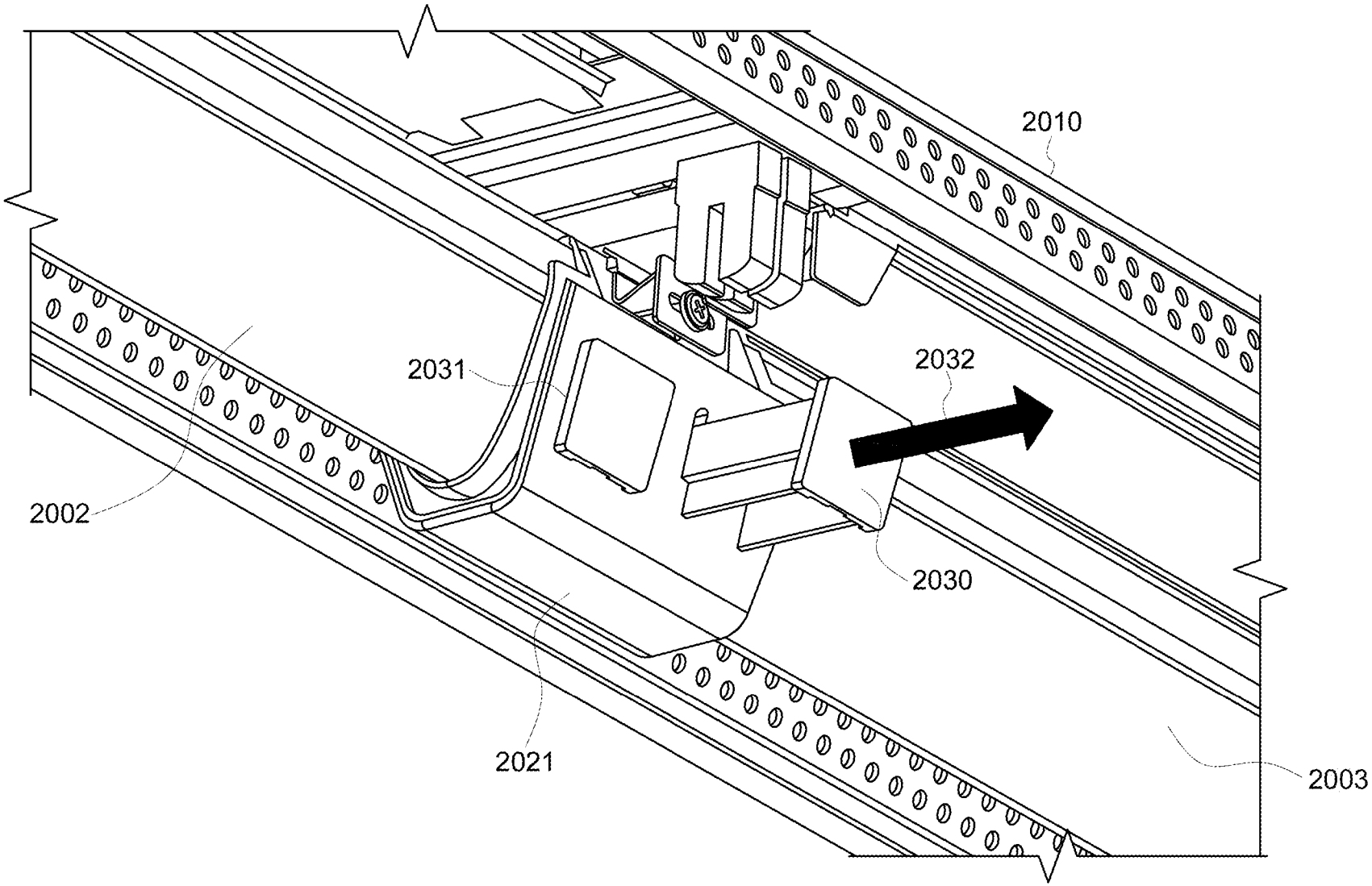
Figure 2F:
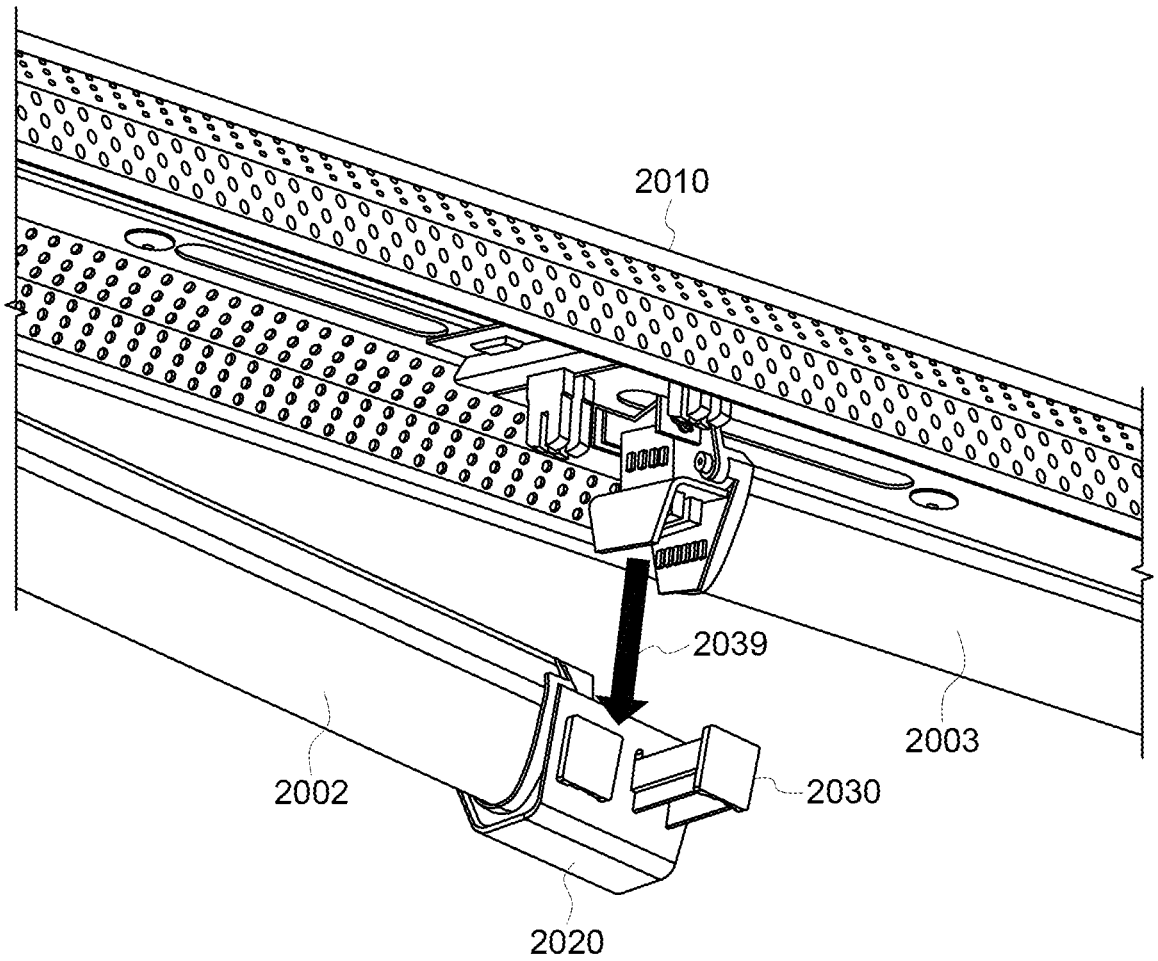
Figure 2G:
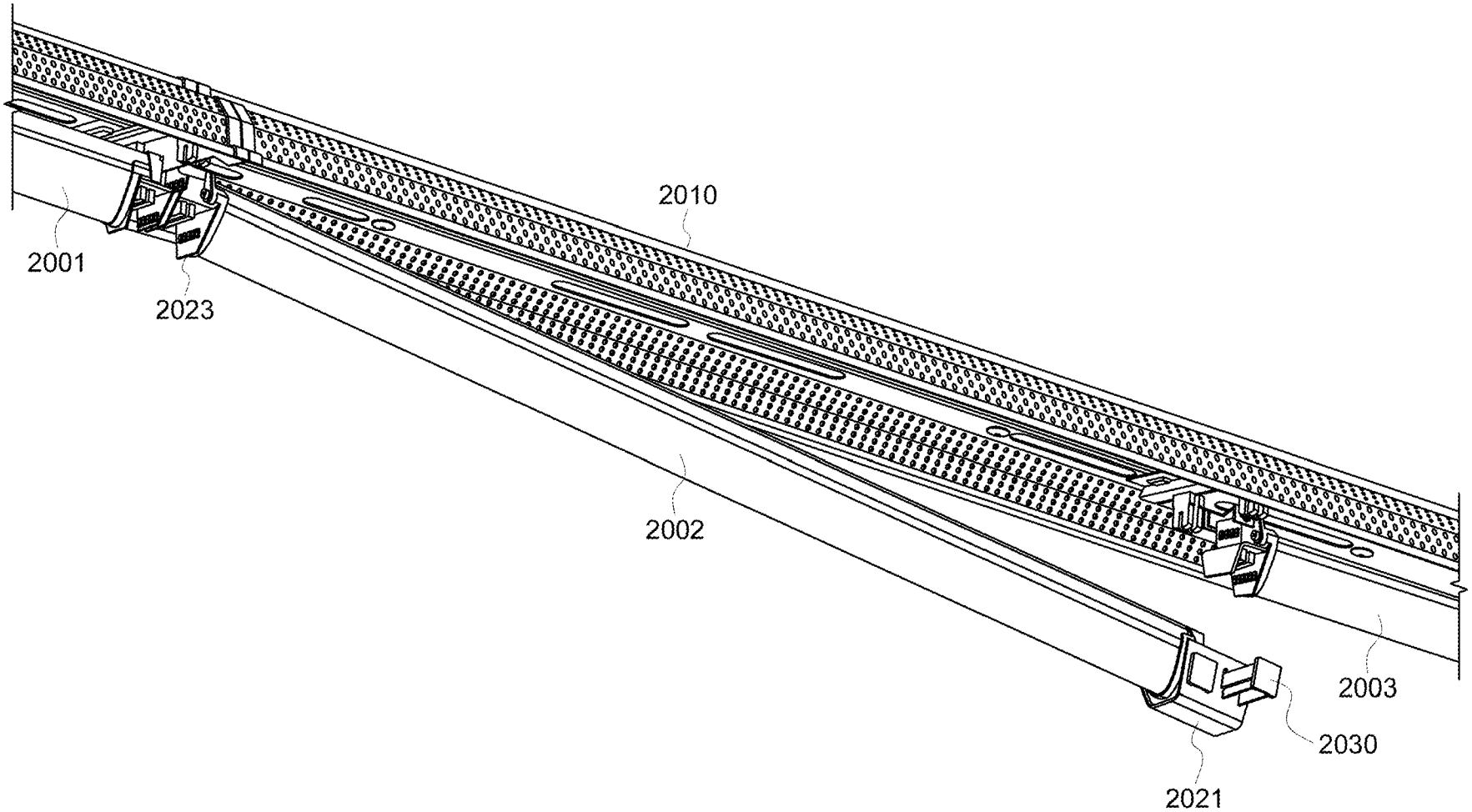

Referring to FIG. 2E, the process continues on the other distal end of the second linear LED luminaire 2002 by removing or detaching the second connecting bridge 2021 (found at the right distal end of the second linear LED luminaire 2002) from the linear light fixture 2010. In some embodiments, this involves pulling out locking tab 2030 in the direction of arrow 2032. As shown in FIG. 2F, after the rightmost locking tab 2030 is pulled fully outward then the right distal end of the LED luminaire 2002 along with the connecting bridge 2021 is detached from the adjacent LED luminaire 2003 and free to swing downwardly (or pivot or rotate downwardly) in the direction of arrow 2039 about a pivot point (which is found within a rotative support bracket 2022 as shown in FIG. 2G). With reference to FIG. 2G, the pivot point for the linear LED luminaire 2002 is located at the left distal end 2023 of the LED luminaire 2002. The installer can then remove the LED luminaire 2002 from the light fixture 2010 by unscrewing it from the pivot point (not shown, but as will be described below).

Figure 3:
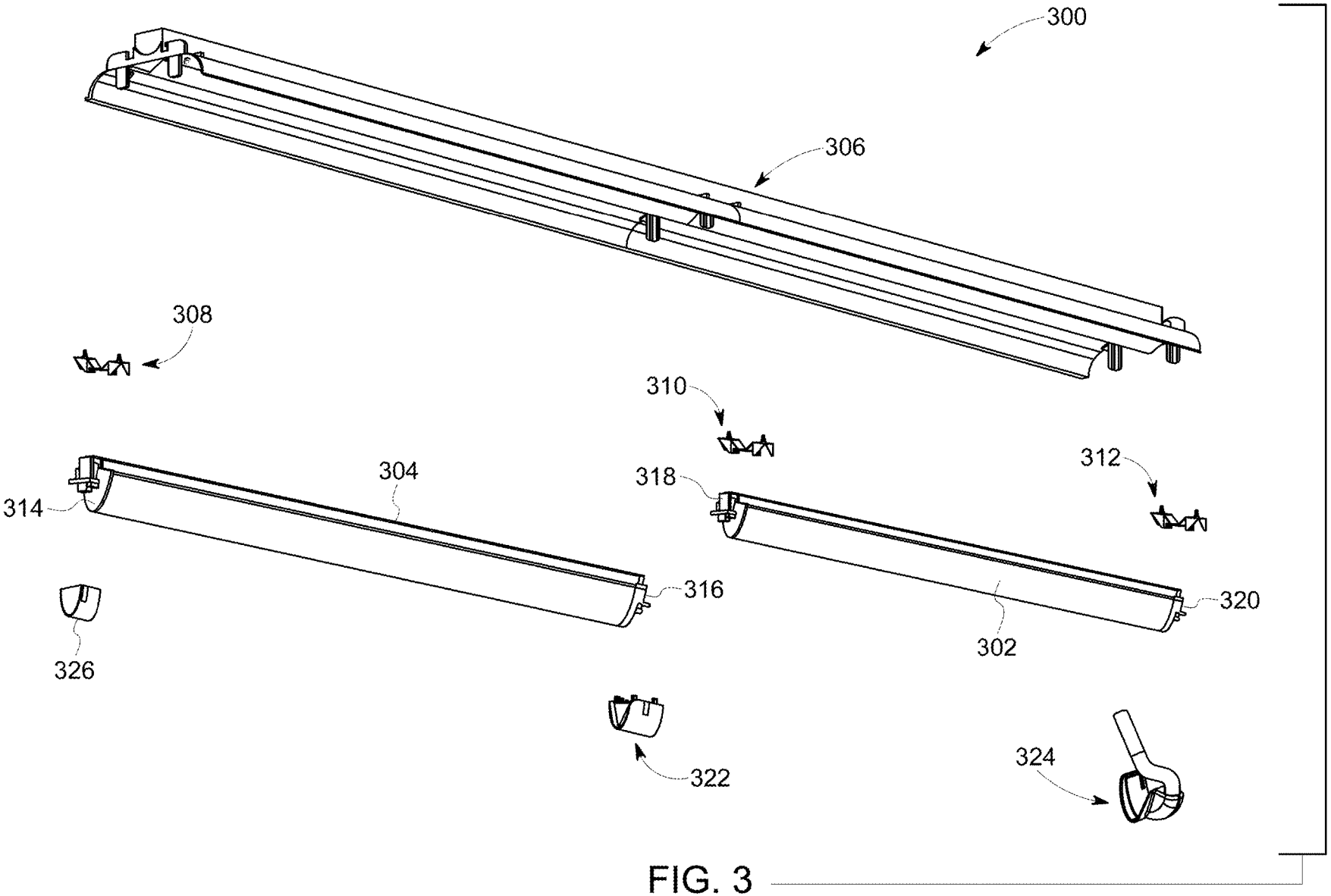
FIG. 3 is an exploded view of an LED luminaire system including a first fully assembled linear LED luminaire, a second fully assembled linear LED luminaire, and a linear light fixture in accordance with some embodiments of the disclosure.

FIG. 3 is an exploded view of an LED luminaire system 300 including a first fully assembled first or starter linear LED luminaire 302, a second fully assembled linear LED luminaire 304 and a linear light fixture 306 in accordance with the disclosure. Also shown are a first rotative suspension bracket 308, a second rotative suspension bracket 310 and third suspension bracket 312, which brackets are to be affixed to the linear light fixture 306 in the implementation shown in FIG. 3. The linear LED luminaires 302 and 304 also include endcaps 314, 316, 318 and 320, to which will be fitted a starter bridge 324, a connecting bridge 322, and a finisher bridge 326. The linear LED luminaires 302 and 304 may be four-foot LED luminaires which will be connected together via the connecting bridge 322. In this implementation, the starter bridge 324 includes a channel or channels therein for bringing electrical power (via wires) from a top portion of the existing linear light fixture 306 into the linear LED luminaires 304 and 306, as a retrofit or replacement. In some embodiments, the connecting bridge 322 is installed to first cover the leftmost endcap 318 of the first LED luminaire 302 and then to cover the rightmost endcap 316 of the second LED luminaire 304 such that both electrical and mechanical connections are made. The finisher bridge 326 is then fitted to the endcap 314 at the left distal end of the LED luminaire 302.

Referring again to FIG. 3, instead of connecting the first rotative suspension bracket 308, second rotative suspension bracket 310 and third suspension bracket 312 to the linear lighting fixture 306, in some embodiments the connection features of the suspension brackets may instead be affixed directly to a ceiling or wall (or other location), for example, at connection points or alignment points (not shown) that are spaced apart for accepting linear LED luminaires. After installation of the brackets, as explained above, the starter bridge 324 may be connected to a source of power and to the suspension bracket 312 and to the endcap 320 of the starter linear LED luminaire 302, and next the endcap 318 can be connected to an attachment portion of the suspension bracket 310 so that the starter LED luminaire is operational and affixed, for example, to a wall or ceiling. In some implementations, the connecting bridge 322 is then connected to endcap 316 of the second linear LED luminaire 304, and the endcap 314 is connected to the third rotative suspension bracket 308 so that the second linear LED luminaire 304 is suspended therefrom. Next, in some implantations the second linear LED luminaire 304 can be rotated so that the connecting bridge 322 is aligned with endcap 318 of the starter linear LED luminaire 302 such that electrical and mechanical attachment and alignment is achieved, and such that both the starter linear LED luminaire 302 and the second linear LED luminaire 304 can emit light when power is provided. Furthermore, in some embodiments the rotative suspension brackets may be modified for attachment to cables (or other apparatus, such as pipes or rods) which may be attached to a ceiling, wall or floor in a configuration for accepting a run of two or more linear LED luminaires.

Figure 4:
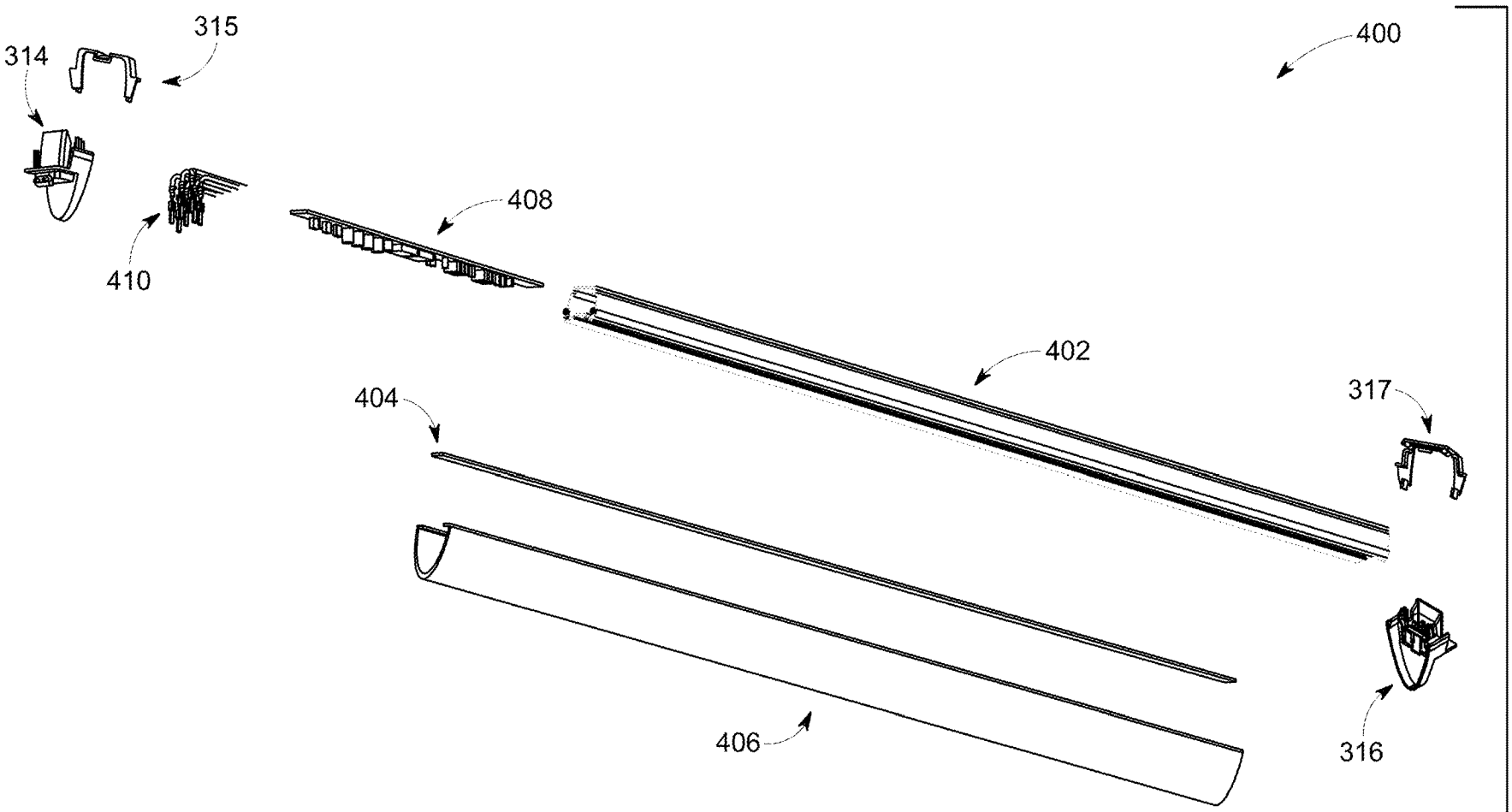
FIG. 4 PRIOR ART
FIG. 4 is an exploded view of a conventional linear LED luminaire.

FIG. 4 illustrates an exploded view of a conventional linear LED luminaire 400, also known as an LED light engine. The linear LED luminaire 400 includes a hollow elongated heatsink 402, which may be made of a metallic material or other type of thermally conductive material. This hollow heatsink 402 has a circuit board assembly (CBA) 404 which is affixed to an outside surface to which is mounted one or more light emitting diodes (LEDs; not shown). Covering the CBA 404 is an optical cover 406 or lens, which distributes and/or diffuses the light emitted from the LEDs resident on the CBA 404. These three items (the elongated hollow heatsink 402, the CBA 404 carrying one or more LEDs, and the optical cover 406) may be considered to be the minimum components required for a linear LED luminaire 400. But in most cases, however, an interior hollow elongated space of the heatsink 402 includes a power supply unit (PSU) 408. In addition, one or more wire connectors and/or crimp connectors 410 and wires (not shown) for carrying electrical power from the linear LED luminaire to a second linear LED luminaire (and ultimately to the wiring of the existing linear light fixture) are snaked through the interior hollow space of the elongated heatsink 402. Also shown are endcaps 314 and 316 and their associated wire caps 315, 317, which are configured to provide the electrical connections from the linear LED luminaire to a second linear LED luminaire.

Figure 5:
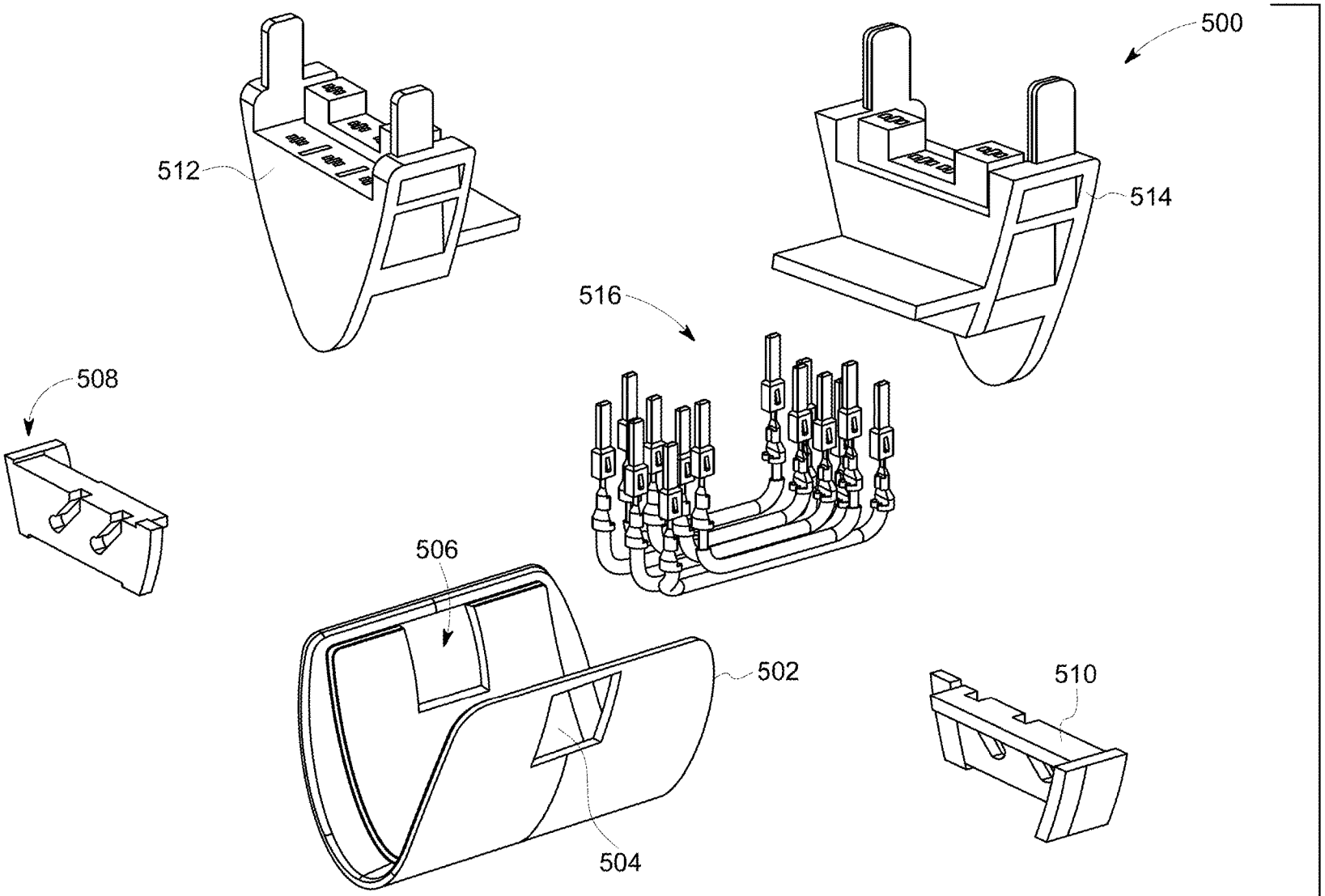
FIG. 5 is an exploded view of a connecting bridge in accordance with some embodiments of the disclosure.

FIG. 5 is an exploded view of an embodiment of a connecting bridge 500 in accordance with the disclosure. The connecting bridge 500 includes a bridge housing 502 that may be made of metal or plastic, such as a hard polymeric material. The shape of the connecting bridge may be similar to and/or complementary to that of the optical cover 406 (see FIG. 4) so that the connecting bridge will appear to a viewer to have an external appearance sufficiently similar to the optical covers of the linear LED luminaires to that adjacent linear LED luminaires appear to be a continuous run of linear Led luminaires. Thus, the bridge component may also be sized and configured to cover the endcaps of each of the linear LED luminaires in a continuous run of such linear LED luminaires.

Referring again to FIG. 5, in some embodiments the connecting bridge 502 has at least two apertures 504, 506 that may receive a first locking tab 508 and a second locking tab 510. The locking tabs 508 and 510, when fully inserted function to hold the connecting bridge in place between two elongated LED luminaires, as described herein. In addition, two wiring bridges 512 and 514 may be included within, or may be integral with, the connecting bridge housing 502. The wiring bridges 512 and 514 are configured to hold the wires which provide electric current between a first linear LED luminaire and an adjacent or second linear LED luminaire that is required to power the LEDs to emit light. In some implementations, the wiring bridges may instead be a single component (not shown; instead of two separate pieces), and may be separate from the connecting bridge housing 502, or it may be integral to it. Also shown in FIG. 5 is an assortment of wires and crimps 516, which may be threaded through the wiring bridges 512 and 514 to facilitate the passage of electric current from a first linear LED luminaire to a second, adjacent linear LED luminaire.

Figure 6:
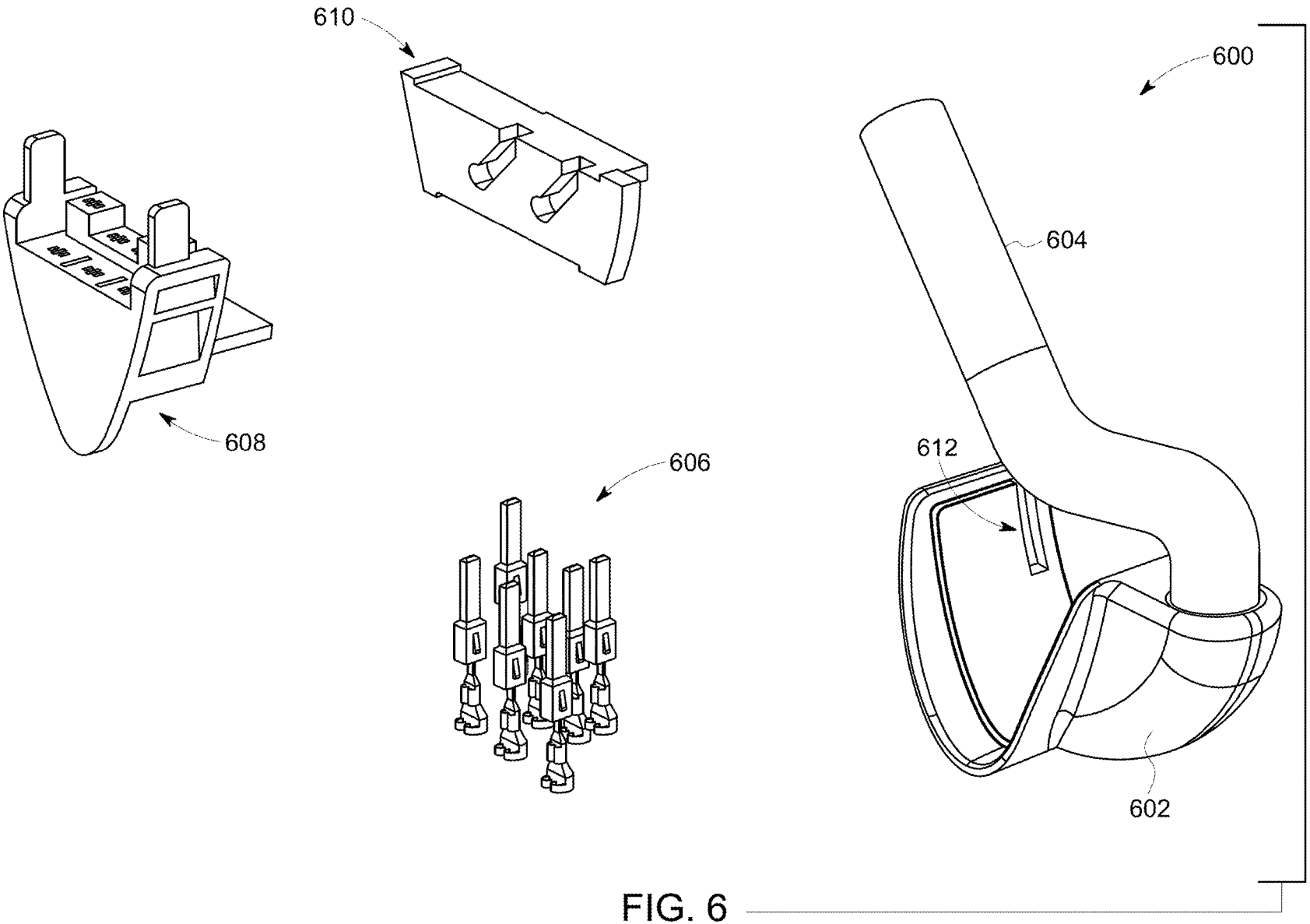
FIG. 6 illustrates an embodiment of a starter bridge in accordance with some embodiments of the disclosure.

FIG. 6 illustrates an embodiment of a starter bridge 600 according to the disclosure. The starter bridge 600 includes a starter bridge housing 602 configured for placement onto and to cover and end cap of a linear LED luminaire, and a conduit portion or wiring bridge section 604 to facilitate the passage of the wiring needed to provide electrical current from the existing light fixture into the continuous run of linear LED luminaires. In some embodiments, the starter bridge housing may be composed of one of a metal material, a plastic material and a hard polymeric material.

Referring again to FIG. 6, the starter bridge 600 may include wire crimps 606 which are configured for holding the electrical wiring (not shown) in place, and such wire crimps 606 may be threaded into or received within a connector part 608. The wiring bridge 604 may be separate from the starter bridge housing 602, or it may be an integral part of the starter bridge housing 602. Also shown is a locking tab 610 that may be inserted into an aperture or slot 612 in the starter bridge housing 602, which locking tab 610 functions to hold or affix the starter bridge housing 602 and internal components in place to an end cap of a linear LED luminaire.

Figure 7:
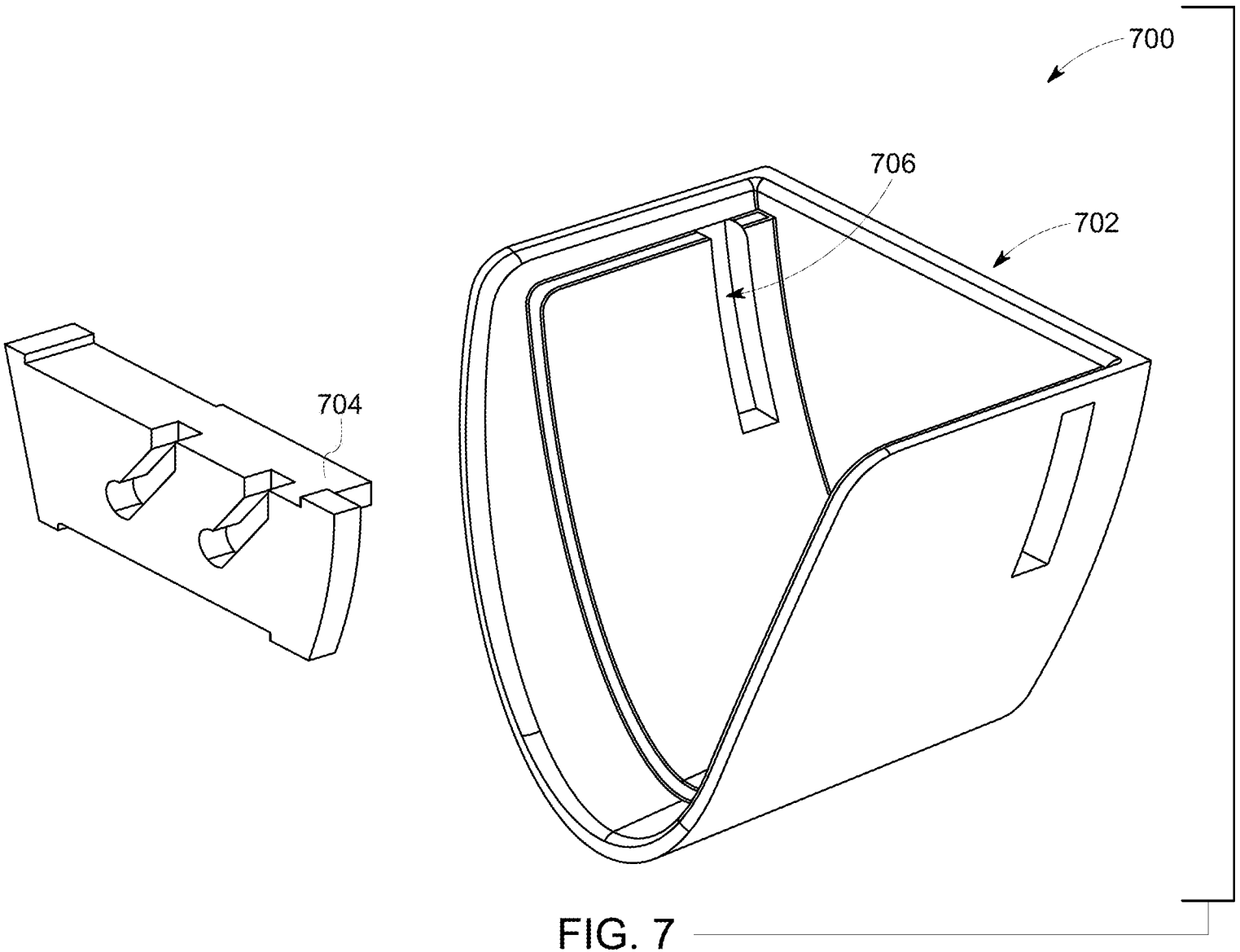
FIG. 7 illustrates an embodiment of a finisher bridge in accordance with some embodiments of the disclosure.

FIG. 7 illustrates an embodiment of a finisher bridge 700 in accordance with the disclosure. The finisher bridge 700 includes a finisher bridge housing 702 configured to fit over an endcap of the last linear LED luminaire in a continuous run or string of linear LED luminaires (not shown). In some implementations, a locking tab 704 is inserted into a slot or aperture or slot 706 in the finishing bridge housing 702 to hold the finisher bridge 700 in place to the end cap of the last linear LED luminaire. Functions of the finisher bridge 700 are to facilitate alignment of the linear LED luminaire and to provide extra mechanical support. In some embodiments, the finisher bridge 700 may be fabricated by using an additive manufacturing process such as a 3-D printing process employing methods such as fused deposition modeling.

Figure 8:
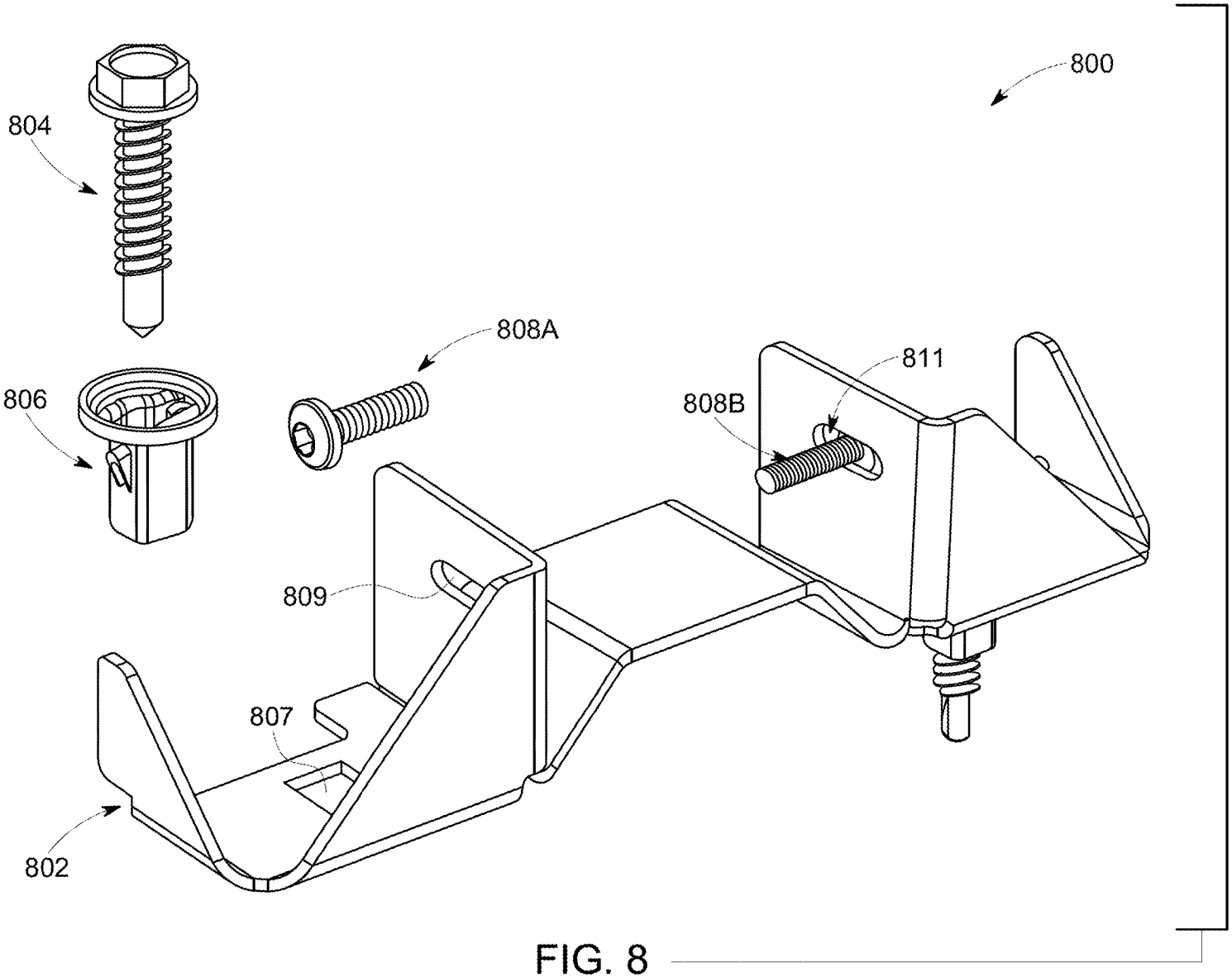
FIG. 8 illustrates an embodiment of a rotative suspension bracket in accordance with some embodiments of the disclosure.

FIG. 8 illustrates an embodiment of a suspension bracket 800 in accordance with the disclosure. In some embodiments, the suspension bracket 800 includes a bracket component 802 having a shape and one or more connection features conducive for affixing by an installer to a connection point. For example, the bracket component may include connection features configured for attachment to an existing linear lamp fixture, for example, via screws (such as sheet metal screws, or other types of connectors such as clips, not show). However, it should be understood that the bracket component 802 may also be installed directly to connection points or alignment points (not shown), for example, on a wall, ceiling or floor that may be spaced apart to facilitate connections to linear LED luminaires. In addition, the bracket component 802 may also be modified so that it can be connected to other, different types of fixtures or devices, for example, to a suspension point (not shown) of a cable, rod or pipe (not shown). The cables, rods and/or pipes may be connected to a wall, ceiling or floor in a spaced apart configuration to facilitate connections to brackets supporting one or more linear LED luminaires.

Referring again to FIG. 8, the bracket component 802 includes an attachment portion configured for attachment to an end of a linear LED luminaire in such a manner that it allows the linear LED luminaire to be rotated in a downward direction (when being removed) or in an upward direction (when being installed) about a pivot point, depending on whether a linear LED luminaire is being installed or removed from a continuous run light fixture. It should be understood that the shape of the bracket component 802 shown in FIG. 8 is for illustrative purposes only, as many possible bracket shapes could may be utilized for such a rotative suspension bracket, and/or for connection to different types of connection points, which may include alignment points and/or or suspension points, as explained herein.

Referring to FIG. 8, in some embodiments one or two screws (for example, the screws 1004, 1006 shown in FIG. 1C) may be used by an installer to affix the rotative suspension bracket component 802 to a linear light fixture. In some embodiments, the screw 804 may be a sheet metal thread cutting screw, or may be another form of self-tapping screw (of a type that punches a threaded hole under pressure of a tool, such as a screw driver, used by the installer). In some implementations, the screw 804 may be threaded through a spacer and/or screw holder 806 for receiving the sheet metal thread cutting screw, and then installed through a connection feature 807, such as an aperture, when an installer connects the suspension bracket component 802, for example, to a continuous run light fixture at a connection point.

Also shown in FIG. 8 are plastic screws 808A and 808B that together form the axis of rotation for a linear LED luminaire. Specifically, after the rotative suspension bracket 800 is affixed to the continuous linear lamp fixture, an installer can then attach a distal end of the linear LED luminaire to the bracket component 802 via the plastic screws 808A and 808B such the linear LED luminaire can rotate about the pivot point created by the plastic screws 808A and 808B. As shown, the plastic screws 808A and 808B are positioned in an approximately perpendicular orientation to the sheet metal thread cutting screw 804 and screw holder 806. In some embodiments, instead of two plastic screws 808A and 808B, a single screw or bolt (not shown) may be utilized to affix a linear LED luminaire to the bracket component 802 via the slots 809 and 811 and to form the axis of rotation for the linear LED luminaire in the rotative suspension bracket 800.

Embodiments disclosed herein advantageously provide mechanisms for easily and quickly connecting two or more elongated LED luminaires to existing lamp fixtures both electrically and mechanically while also providing alignment of the respective LED luminaires. Thus, some embodiments provide a "continuous run" of LED luminaires, which generally refers to a linear arrangement of such lamps with no intervening breaks. Also, in some disclosed embodiments of the assembly method, pre-existing "tombstones" found on conventional fluorescent lamp fixtures may be utilized to anchor and/or position newly-installed retrofit LED luminaires. Thus, the methods described herein can utilize existing features of lamp fixtures to mount brackets for accommodating installation of new or retrofit LED luminaires.

The above descriptions and/or the accompanying drawings are not meant to imply a fixed order or sequence of steps for any process or method of manufacture referred to herein. Thus, any disclosed process may be performed in any order that is practicable, including but not limited to simultaneous performance of one or more steps that are indicated as sequential.

Although the present invention has been described in connection with specific exemplary embodiments, various changes, substitutions, modifications and/or alterations apparent to those skilled in the art can be made to the disclosed voice activated lighting apparatus and/or voice activated lamp system embodiments without departing from the spirit and scope of the invention as set forth in the appended claims.

What is claimed is:

1. A system for installing a linear LED luminaire, comprising:

a rotative suspension bracket comprising at least one connection feature for attachment to a connection point and a means forming an axis of rotation for a first linear LED luminaire, and an attachment portion for accepting a first end of a first linear LED luminaire; and a connecting bridge comprising a bridge housing, at least one aperture formed in the bridge housing, and at least one tab, the connecting bridge for attachment to a second end of the first linear LED luminaire, wherein the means forming the axis of rotation enables rotation of the first linear LED luminaire and the attached connecting bridge towards a second LED luminaire during installation of the first linear LED luminaire thus enabling mechanical and electrical connection between the first linear LED luminaire and the second LED luminaire when the first linear LED luminaire is aligned with the second LED luminaire and the at least one tab is inserted into the at least one aperture.

2. The system of claim 1, further comprising a starter bridge comprising a starter bridge housing and a wiring bridge, the starter bridge housing for attachment to a distal end of a starter linear LED luminaire of a continuous row of linear LED luminaires, and wherein the wiring bridge enables passage of electrical wires through the starter linear LED luminaire and enables connection to at least one additional LED luminaire via the connecting bridge.

3. The system of claim 1, further comprising a finisher bridge comprising a finisher bridge housing including at least one aperture and a locking tab, the finisher bridge for attachment to a distal end of a linear LED luminaire that comprises a final linear LED luminaire of a continuous run of linear LED luminaires.

4. The system of claim 2, wherein the starter bridge housing further comprises wire crimps configured for holding the electrical wires.

5. The system of claim 2, wherein the starter bridge further comprises at least one aperture in the starter bridge housing and a tab for insertion into the aperture enabling both a mechanical and an electrical connection of the starter bridge to the starter linear LED luminaire.

6. The system of claim 2, wherein the starter bridge housing is composed of one of a metal material, a plastic material and a hard polymeric material.

7. The system of claim 1, wherein the at least one connection feature of the suspension bracket connects to one of an alignment point of a linear light fixture, a connection point of a ceiling, a wall or a floor, or a suspension point of a cable, rod or pipe.

8. The system of claim 1, wherein the shape of an outer portion of the bridge housing of the connecting bridge is similar to that of an optical cover of a linear LED luminaire.

9. The system of claim 1, wherein the connecting bridge comprises at least two apertures for receiving a first tab associated with the first linear LED luminaire and a second locking tab associated with an adjacent second linear LED luminaire.

10. The system of claim 1, wherein the connecting bridge is composed of one of a metal material, a plastic material and a hard polymeric material.

11. A method for installing a linear LED luminaire, comprising:

affixing a rotative suspension bracket having at least one connection feature to a connection point, the rotative suspension bracket comprising a means forming an axis of rotation for a first linear LED luminaire, and including an attachment portion for accepting a first end of the first linear LED luminaire;

affixing a first end of a connecting bridge to a first end of the first linear LED luminaire, the connecting bridge comprising a bridge housing, at least one aperture formed in the bridge housing, and at least one tab;

connecting a second end of the first linear LED luminaire to the attachment portion of the rotative suspension bracket; and connecting a second end of the connecting bridge to a second end of a second linear LED luminaire by rotating the first linear LED luminaire about the axis of rotation of the rotative suspension bracket until the connecting bridge aligns with the second linear LED luminaire enabling mechanical and electrical connection between the first linear LED luminaire and the second LED luminaire.

12. The method of claim 11, wherein the connection point comprises one of an alignment point of a linear light fixture, a connection point of a ceiling, a wall or a floor, or a suspension point of a cable, rod or pipe.

13. The method of claim 11, further comprising affixing a finisher bridge to the second end of the first linear LED luminaire.

* * * * *